US005961745A

United States Patent [19]

Inoue et al.

[11] Patent Number: 5,961,745

[45] Date of Patent: Oct. 5, 1999

[54] FE BASED SOFT MAGNETIC GLASSY ALLOY

[75] Inventors: Akihisa Inoue, 11-806 Kawauchijutaku, 35banchi, Motohasekura, Aoba-ku, Sendai-shi, Miyagi-ken; Takao Mizushima, Niigata-ken; Kouichi Fujita, Miyagi-ken; Oki Yamaguchi; Akihiro Makino, both of Niigata-ken, all of Japan

[73] Assignees: Alps Electric Co., Ltd.; Akihisa Inoue; Japan Science and Technology Corp., all of, Japan

[21] Appl. No.: 08/832,325

[22] Filed: Mar. 26, 1997

[30] Foreign Application Priority Data

Mar. 25, 1996 [JP] Japan ..... 8-068818
Sep. 13, 1996 [JP] Japan ..... 8-243756

[51] Int. Cl.[6] ..... H01F 1/153

[52] U.S. Cl. ..... 148/304; 148/403

[58] Field of Search ..... 148/304, 403

[56] References Cited

U.S. PATENT DOCUMENTS

| | | | |
|---|---|---|---|
| 4,859,256 | 8/1989 | Sawa et al. | 148/304 |
| 5,032,196 | 7/1991 | Masumoto et al. | 148/403 |
| 5,312,495 | 5/1994 | Masumoto et al. | 148/550 |
| 5,362,339 | 11/1994 | Horimura et al. | 148/403 |
| 5,738,733 | 4/1998 | Inoue | 148/403 |

*Primary Examiner*—John Sheehan
*Attorney, Agent, or Firm*—Brinks Hofer Gilson & Lione

[57] ABSTRACT

The present invention is directed to provide a Fe based glassy alloy which exhibits soft magnetic characteristics at room temperature, has a thickness greater than that of a conventional amorphous alloy prepared by a liquid quenching process and can be easily formed in bulk. The Fe based glassy alloy in accordance with the present invention has a temperature distance $\Delta T_x$, expressed by the equation $\Delta T_x = T_x - T_g$, of a supercooled liquid of not less than 35° C., wherein Tx indicates crystallization temperature and Tg represents glass transition temperature.

1 Claim, 27 Drawing Sheets

FE BASED SOFT MAGNETIC GLASSY ALLOY

BACKGROUND OF THE INVENTION

1. Field of the Invention

The present invention relates to a Fe based glassy alloy having a larger thickness as compared to prior art amorphous alloy ribbons, and exhibiting excellent magnetic characteristics and high resistivity.

2. Description of the Related Art

It has been known that some multi-element amorphous alloys have wide supercooling temperature ranges before crystallization and form glassy alloys. Also, it has been known that such glassy alloys can be formed as bulk alloys having significantly larger thicknesses than amorphous alloy ribbons formed by prior art liquid quenching processes.

Examples of prior art glassy alloys include Ln-Al-TM alloys, Mg-Ln-Tm alloys, Zr-Al-TM alloys, Hf-Al-TM alloys and Ti-Zr-Be-TM alloys, wherein Ln indicates a rare earth element and TM indicates a transition metal element. However, these glassy alloys do not exhibit magnetic characteristics at room temperature, and thus, they cannot be used as magnetic materials in industrial fields. Accordingly, research and development on thin bulk glassy alloys exhibiting magnetic characteristics at room temperature have been carried out.

In glassy alloys of various compositions capable of a supercooled liquid state, the temperature difference between the crystallization temperature ($T_x$) and the glass transition temperature ($T_g$), i.e., ($T_x$–$T_g$) is generally too low to form a practically useful glassy alloy. Thus, an alloy having a wide supercooled temperature range and a capability of forming a glassy alloy by supercooling has attracted attention in metallurgic fields, because such an alloy can overcome the thickness restrictions of known amorphous alloys. Accordingly, development of a glassy alloy exhibiting ferromagnetic characteristics at room temperature has been eagerly awaited.

SUMMARY OF THE INVENTION

It is an object of the present invention to provide a Fe based glassy alloy, which exhibits soft magnetic characteristics at room temperature, has a larger thickness than an amorphous alloy prepared by a conventional supercooling process, can be formed in bulk, and has a high resistivity.

In accordance with the present invention, a Fe based soft magnetic glassy alloy is characterized in that a temperature difference $\Delta T_x$ of a supercooled liquid of said glassy alloy expressed by the equation $\Delta T_x = T_x - T_g$, wherein $T_x$ represents crystallization temperature and $T_g$ represents glass transition temperature, is not less than 35° C., and a resistivity is not less than 1.5 $\mu\Omega$m.

The Fe based soft magnetic glassy alloy may contain a metallic element other than Fe and a metalloid element.

The metalloid element preferably comprises at least one element selected from the group consisting of P, C, B and Ge.

The metalloid element may comprise at least one element selected from the group consisting of P, C, B, Ge and Si.

The metallic element other than Fe preferably comprises at least one metallic element belonging to Groups IIIB and IVB of the Periodic Table.

The metallic element other than Fe preferably comprises at least one element selected from the group consisting of Al, Ga, In and Sn.

In one embodiment, the Fe based soft magnetic glassy alloy comprises: 1 to 10 atomic percent of Al, 0.5 to 4 atomic percent of Ga, 9 to 15 atomic percent of P, 5 to 7 atomic percent of C, 2 to 10 atomic percent of B, and the balance being Fe.

IN an alternative embodiment the Fe based soft magnetic glassy alloy comprises: 1 to 10 atomic percent of Al, 0.5 to 4 atomic percent of Ga, 9 to 15 atomic percent of P, 5 to 7 atomic percent of C, 2 to 10 atomic percent of B, 0 to 15 atomic percent of Si, and the balance being Fe.

In another alternative embodiment, the Fe based soft magnetic glassy alloy further comprises 0 to 4 atomic percent of Ge.

In yet another alternative embodiment, the Fe based soft magnetic glassy alloy further comprise not more than 7 atomic percent of at least one element selected from the group consisting of Nb, Mo, Hf, Ta, W, Zr and Cr.

The Fe based soft magnetic glassy alloy is a ribbon having a thickness of not less than 20 $\mu$m.

The Fe based soft magnetic glassy alloy is more preferably a ribbon having a thickness between 20 $\mu$m and 200 $\mu$m.

The Fe based soft magnetic glassy alloy is more preferably a ribbon having a thickness between 20 $\mu$m and 250 $\mu$m.

The Fe based soft magnetic glassy alloy has a halo X-ray diffraction pattern.

The Fe based soft magnetic glassy alloy may be annealed at a temperature between 300° C. and 500° C.

In the Fe based soft magnetic glassy alloy in accordance with the present invention, since a temperature difference $\Delta T_x$ of the supercooled liquid is not less than 35° C. and the glassy alloy has a resistivity of not less than 1.5 $\mu\Omega$m, a bulk glassy alloy, which overcomes restriction on thickness inherent in conventional amorphous alloy ribbons and exhibits soft magnetic characteristics at room temperature, can be obtained.

The Fe based soft magnetic glassy alloy in accordance with the present invention has a thickness of not less than 20 $\mu$m, particularly between 20 and 200 Δm, and more particularly between 20 and 250 $\mu$m when containing Si, has a resistivity of not less than 1.5 $\mu\Omega$m, and exhibits soft magnetic characteristics at room temperature. In detail, the bulk Fe based soft magnetic glassy alloy has high saturation magnetization, low coercive force, and high permeability.

DESCRIPTION OF THE PREFERRED EMBODIMENTS

Figure 1:
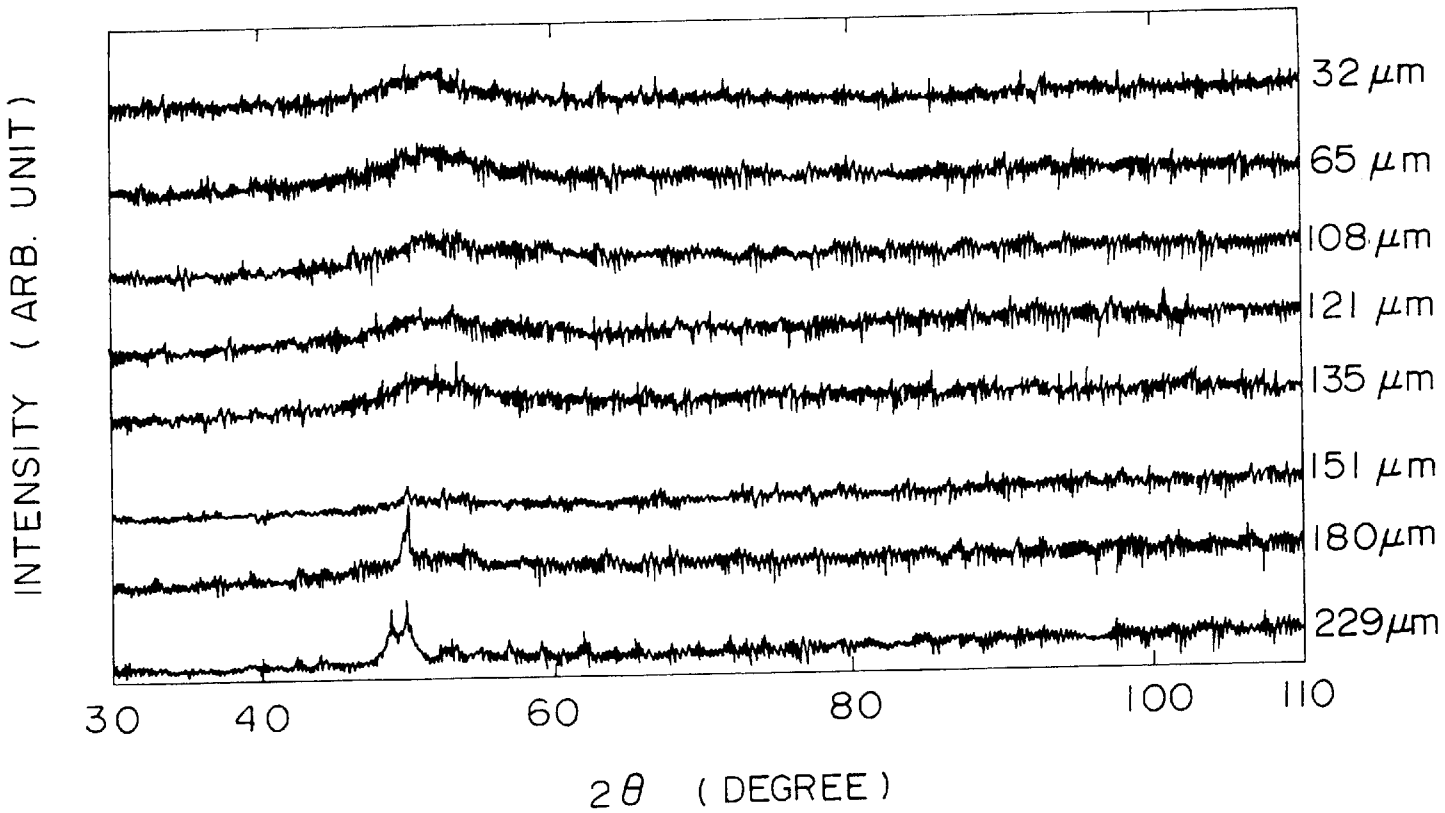
FIG. 1 is a graph illustrating X-ray diffraction patterns of samples having various thicknesses between 35 $\mu$m and 229 $\mu$m.

The present invention will now be described with reference to the drawings.

Among Fe alloys, it has been known that Fe-P-C alloys, Fe-P-B alloys and Fe-Ni-Si-B alloys have glass transitions. However, the temperature differences $\Delta T_x$ of the supercooled liquids of these alloys are not more than 25° C., which is extremely low for practically forming glassy alloys.

In contrast, the Fe based soft magnetic glassy alloy in accordance with the present invention has an unexpectedly large temperature difference $\Delta T_x$ of more than 35° C., or more than 40–50° C. for specific compositions. Further, the Fe based soft magnetic glassy alloy exhibits excellent soft magnetic characteristics at room temperature. Moreover, a bulk glassy alloy, which is significantly useful as compared to amorphous alloy ribbon, is obtainable from the Fe based composition.

The Fe based soft magnetic glassy alloy has a composition comprising Fe as a major component, a metallic element other than Fe and a metalloid element. The metallic element other than Fe is selected from the group consisting of Groups IIA, IIIA, IIIB, IVA, IVB, VA, VIA and VIIA elements of the Periodic Table. Among them, Groups IIIB and IVB elements are preferably used. Examples of preferred metallic elements include Al (aluminum), Ga (gallium), In (indium) and Sn (tin). The Fe based soft magnetic glassy alloy may further contain at least one metallic element selected from the group consisting of Ti (titanium), Hf (hafnium), Cu (copper), Mn (manganese), Nb (niobium), Mo (molybdenum), Cr (chromium), Ni (nickel), Co (cobalt), Ta (tantalum), W (tungsten) and Zr (zirconium). Examples of the metalloid elements include P (phosphorus), C (carbon), B (boron), Si (silicon) and Ge (germanium).

In detail, the Fe based soft magnetic glassy alloy in accordance with the present invention comprises: 1 to 10 atomic percent of Al, 0.5 to 4 atomic percent of Ga, 9 to 15 atomic percent of P, 5 to 7 atomic percent of C, 2 to 10 atomic percent of B, and the balance being Fe and incidental impurities.

Addition of Si increases the temperature difference $\Delta T_x$ of the supercooled liquid, and thus increases the critical thickness to form a single amorphous phase. As a result, a thicker glassy alloy having superior soft magnetic characteristics at room temperature can be prepared. When excessive Si is present, the supercooling liquid region (temperature difference) $\Delta T_x$ will disappear. Thus, the preferable Si content is not more than 15%.

In detail, the Fe based soft magnetic glassy alloy preferably comprises: 1 to 10 atomic percent of Al, 0.5 to 4 atomic percent of Ga, 9 to 15 atomic percent of P, 5 to 7 atomic percent of C, 2 to 10 atomic percent of B, 0 to 15 atomic percent of Si, and the balance being Fe and incidental impurities.

The Fe based soft magnetic glassy alloy may further comprise 0 to 4 atomic percent and preferably 0.5 to 4% of Ge. Also, the Fe based soft magnetic glassy alloy may comprise not more than 7% of at least one element selected from the group consisting of Nb, Mo, Cr, Hf, W and Zr, and not more than 10% of Ni and not more than 30% of Co.

In each composition set forth above, the supercooled alloy liquid has a temperature difference $\Delta T_x$ of not less than 35° C., or not less than 40–50° C. in specified compositions.

The Fe based soft magnetic glassy alloy in accordance with the present invention can be produced into a desirable shape, e.g. bulk, ribbon, wire or powder, by a casting process, a quenching process with a single roll or a twin roll, an in-rotating water melt spinning process, a solution extraction process, or a high-pressure gas spraying process. The thickness or diameter of the Fe based soft magnetic glassy alloy obtained in such a manner is at least ten times larger than that of conventional amorphous alloys.

The resulting Fe based soft magnetic glassy alloy exhibits magnetic characteristics at room temperature. The magnetic characteristics are improved by annealing. Thus, the Fe based soft magnetic glassy alloy can be used in various magnetic applications.

In the production of the Fe based soft magnetic glassy alloy in accordance with the present invention, an optimal cooling rate depends on the alloy composition, the production process and the size and shape of the product. The cooling rate generally ranges from 1 to $10^4$ ° C./sec. The cooling rate is determined while confirming crystal phase formation, such as a $Fe_3B$, $Fe_2B$ or $Fe_3P$ phase. In the present invention, it is preferred that there be large differences in atomic diameter between the added elements. Such large differences increase the packing density in a liquid state. As a result, the solid/liquid interfacial energy increases and crystal nucleus formation is suppressed.

EXAMPLE

The Fe based soft magnetic glassy alloy in accordance with the present invention will be described in detail with reference to Examples.

Example 1

Fe, Al, Ga, a Fe-C alloy, a Fe-P alloy, and B were weighed based on a given formulation and melted using a high frequency induction heater in a reduced pressure Ar atmosphere. An ingot having a composition of $Fe_{73}Al_5Ga_2P_{11}C_5B_4$, wherein subscripts represent atomic percent, was prepared. The ingot was melted in a crucible and injected on a rotating single roll through an ingot nozzle in a reduced Ar atmosphere to quench the melt. A series of quenched ribbons having thicknesses of 35 to 229 μm were prepared by such a single roll process while varying the nozzle diameter, the distance or gap between the nozzle tip and the roll surface, the roll rotation frequency, the injection pressure and the atmosphere pressure as set forth in Table 1.

TABLE 1

| Thickness (μm) | Nozzle diameter (mm) | Gap (mm) | Rotation frequency (r.p.m.) | Injection pressure (kgf/cm$^2$) | Atmosphere pressure (cmHg) |
|---|---|---|---|---|---|
| 108 | 0.42 | 0.3 | 500 | 0.35 | −10 |
| 151 | 0.42 | 0.3 | 350 | 0.35 | −10 |
| 66 | 0.42 | 0.3 | 800 | 0.35 | −10 |
| 124 | 0.41 | 0.3 | 400 | 0.30 | −10 |
| 125 | 0.41 | 0.3 | 400 | 0.30 | −10 |
| 35 | 0.42 | 0.3 | 1500 | 0.35 | −10 |
| 180 | 0.42 | 0.3 | 250 | 0.30 | −10 |
| 229 | 0.42 | 0.6 | 250 | 0.40 | −10 |

FIG. 1 is a graph including X-ray diffraction pat terns of the samples set forth in Table 1. FIG. 1 demonstrates that each sample having a thickness between 35 and 135 μm has a halo diffraction pattern and a microstructure comprising a single amorphous phase. In contrast, each sample having a thickness of 151 μm or 180 μm has a sharp diffraction peak near 2θ=50°. The sharp diffraction peak indicates the presence of $Fe_2B$ crystal. The sample having a thickness of 229 μm has another diffraction peak, which indicates the presence of $Fe_3B$ crystal grains, in addition to the above-mentioned diffraction peak.

These results illustrate that a ribbon having a single amorphous phase structure can be obtained in a thickness range from 35 to 135 μm from an alloy having a composition in accordance with the present invention by a single roll process. Further, each sample having a thickness between 151 and 229 μm is also mainly composed of the amorphous phase, although a compound phase precipitates.

Figure 2:
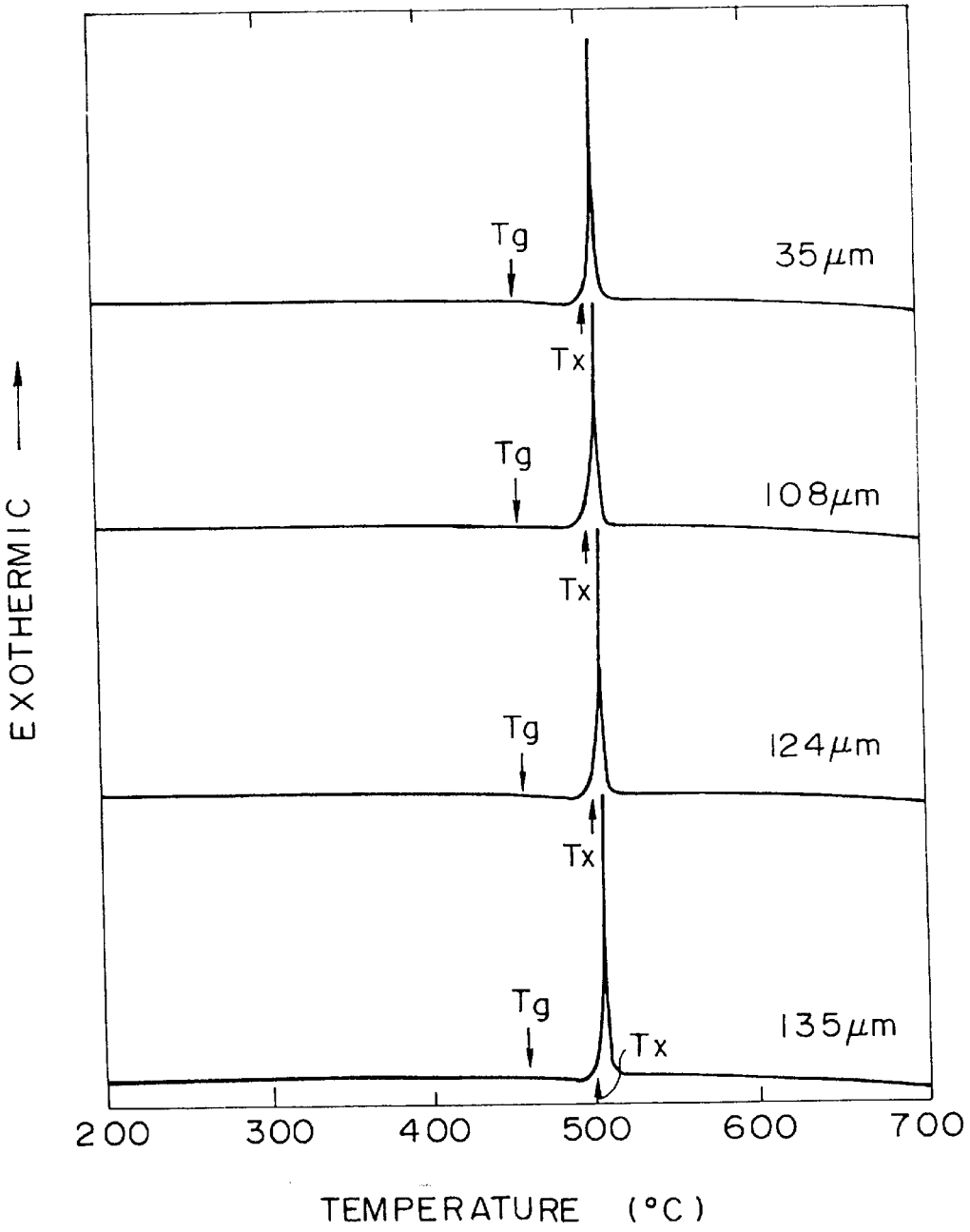
FIG. 2 includes DSC thermograms of samples having various thicknesses between 35 $\mu$m and 229 $\mu\Omega$m.
Figure 3:
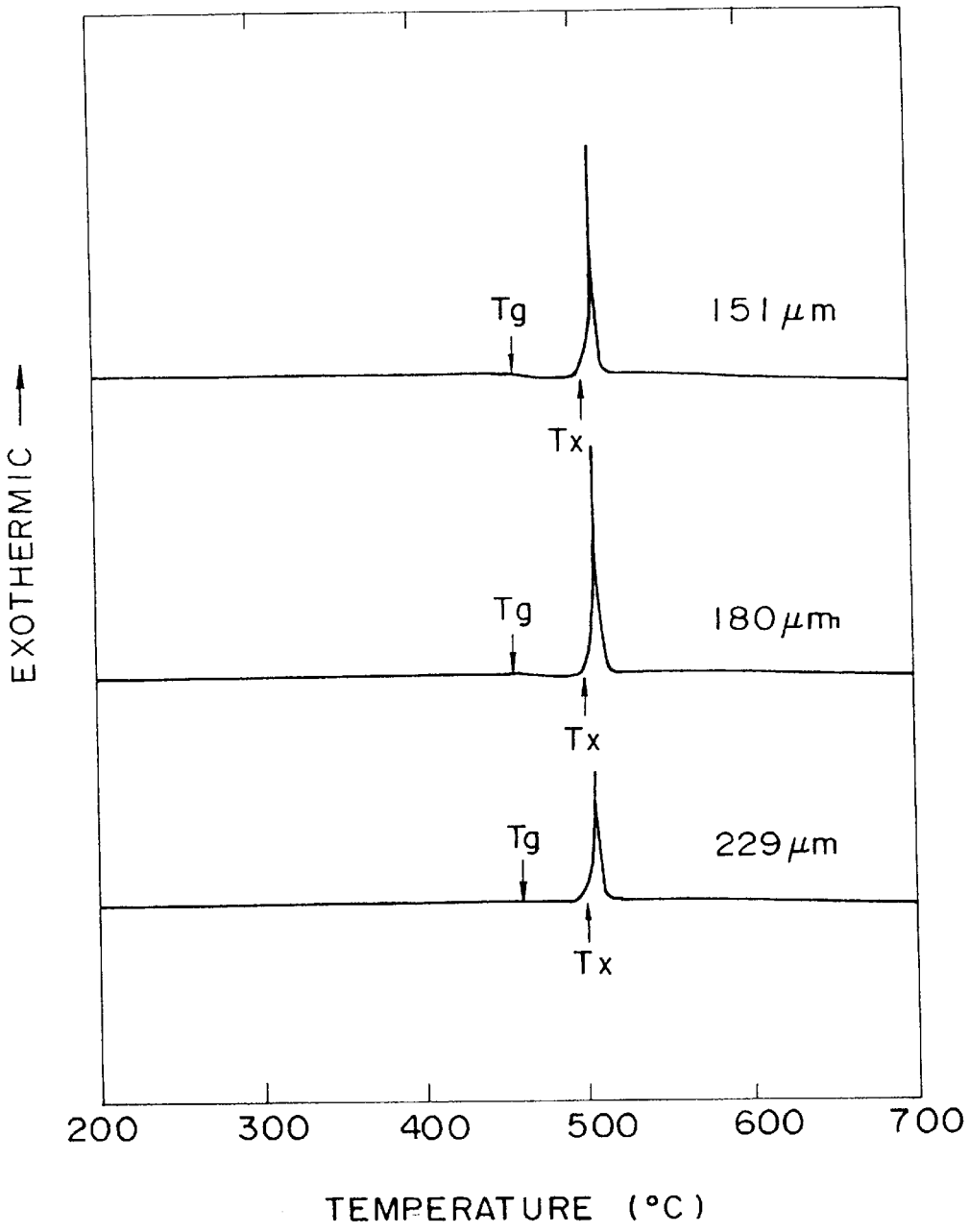
FIG. 3 includes DSC thermograms of samples having various thicknesses between 151 $\mu$m and 229 $\mu$m.

FIGS. 2 and 3 include DSC (differential scanning calorimetric) thermograms of the ribbons set forth in Table 1. FIGS. 2 and 3 demonstrate that each alloy has a wide supercooled liquid region below the crystallization temperature, or a large temperature difference $\Delta T_x = T_x - T_g$, and the alloy exhibits a high amorphous phase formability. Further, FIG. 3 suggests that the sample having a thickness of 229 μm also includes an amorphous phase.

Figure 4:
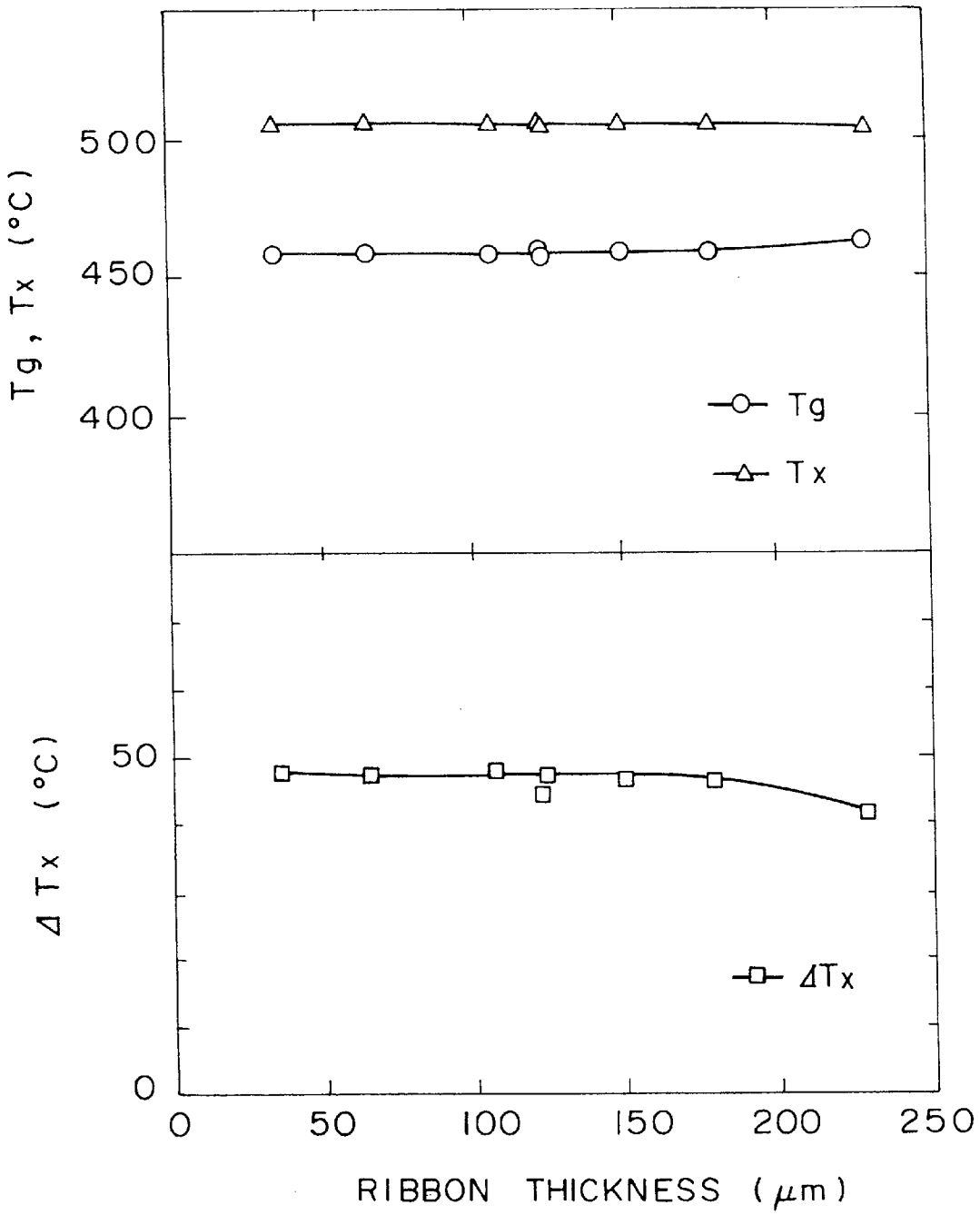
FIG. 4 is a graph illustrating change in crystallization temperature Tx, glass transition temperature Tg and ΔTx at various thicknesses.

FIG. 4 is a graph illustrating the dependence of $T_x$, $T_g$ and $\Delta T_x$ on thickness, wherein $T_x$, $T_g$ and $\Delta T_x$ values were taken from the DSC thermograms in FIGS. 2 and 3. FIG. 4 suggests that the $T_x$ value is approximately 506° C. and not dependent on thickness, and the $T_g$ value is also constant, i.e, 458° C., except for the sample having a thickness of 229 μm which has a slightly higher $T_g$ value. Thus, each sample other than the sample having a thickness of 229 μm has a constant $\Delta T_x$ of approximately 47° C.

Figure 5:
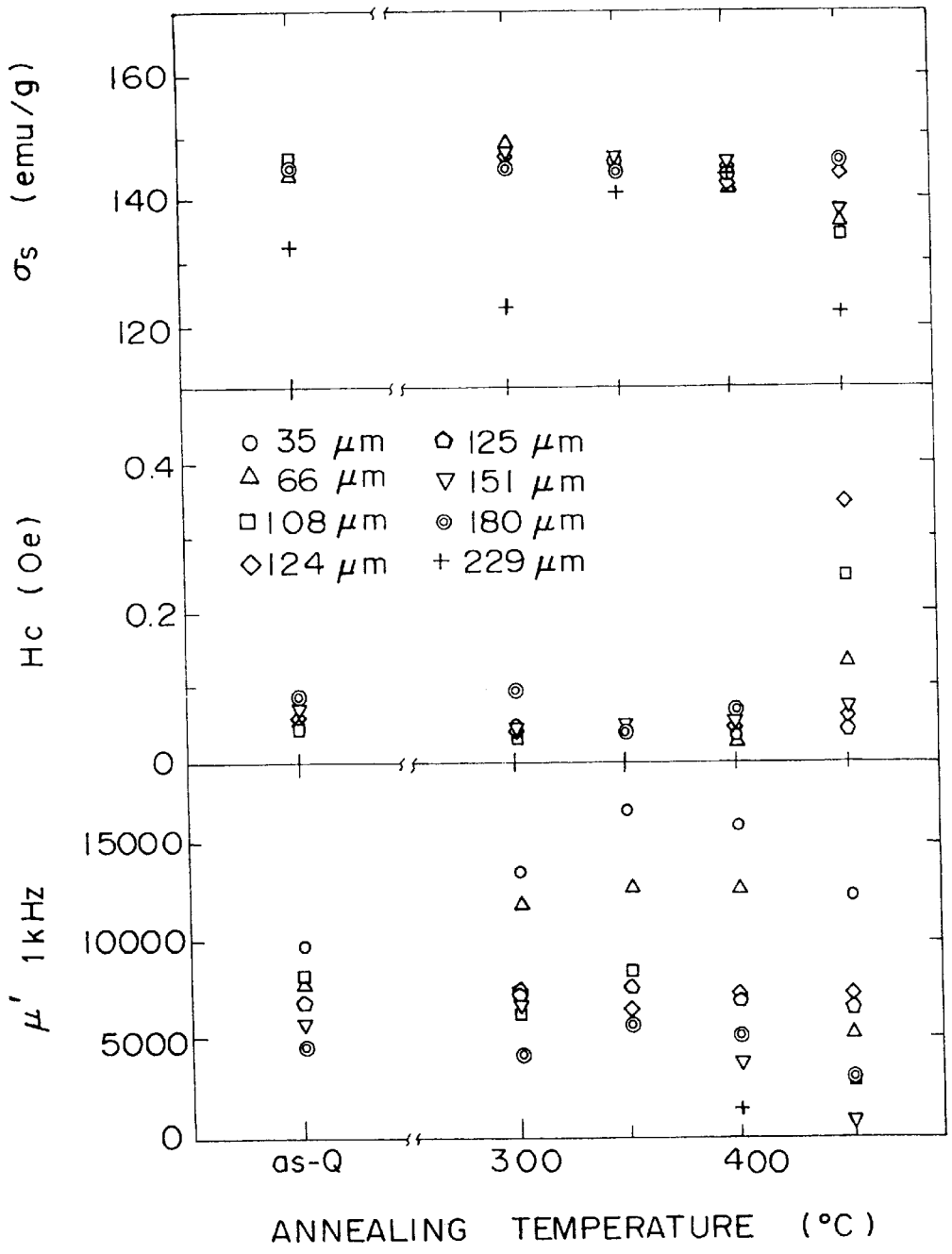
FIG. 5 is a graph illustrating change in saturation magnetization, coercive force and permeability at various thicknesses.
Figure 6:
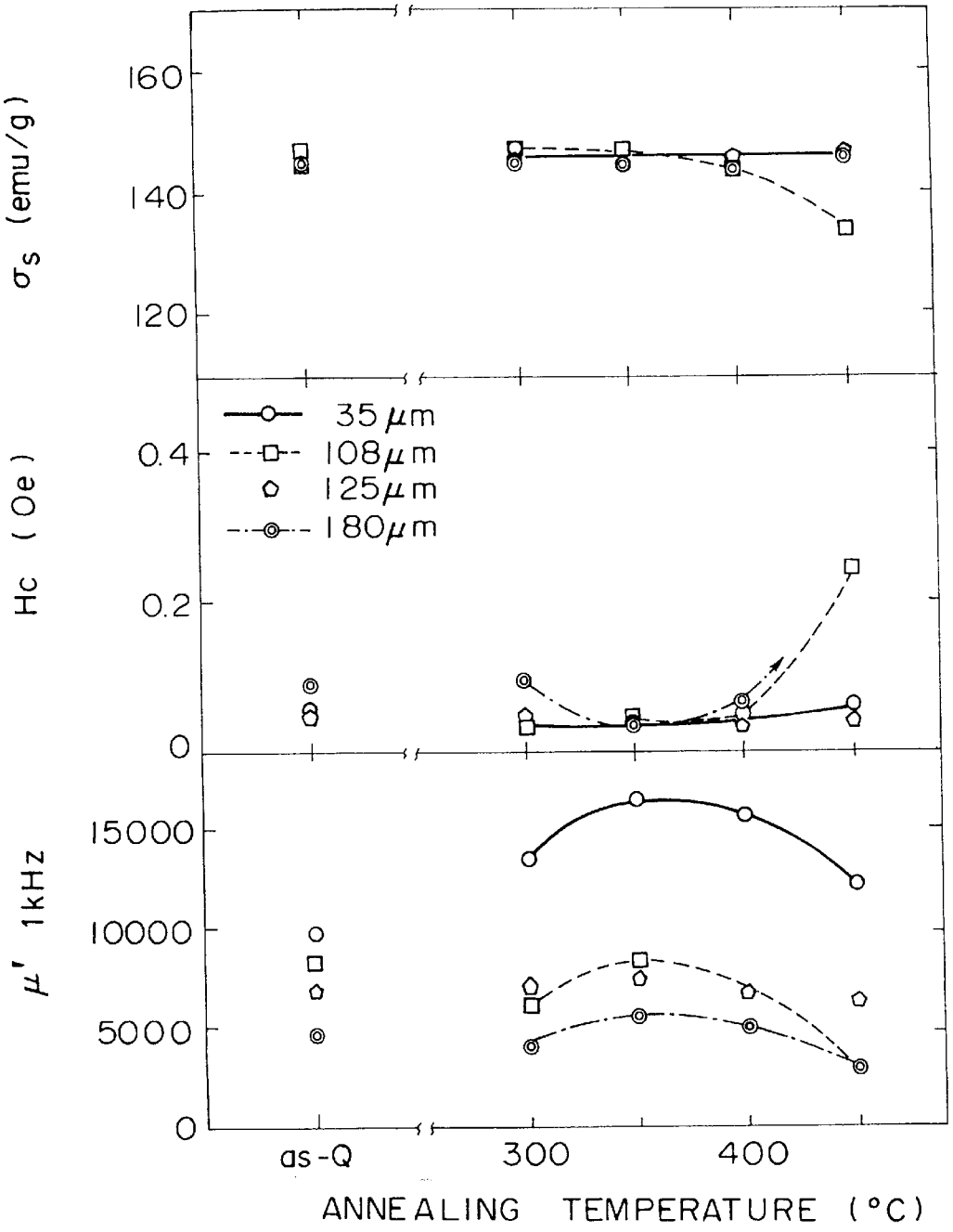
FIG. 6 is a graph based on data partially extracted from FIG. 5.

Magnetic characteristics of each ribbon were determined after annealing at temperatures between 300° C. and 450° C. Annealing was carried out at a heating rate of 180° C./min. and a holding time of 10 minutes in vacuo using an infrared image furnace. FIG. 5 is a graph illustrating the dependence of magnetic characteristics on annealing temperature of each ribbon. Data of typical samples is extracted from FIG. 5 and shown in FIG. 6 again. FIGS. 5 and 6 demonstrate that saturation magnetization ($\sigma_s$) of each sample having a thickness of 35 to 180 μm does not change by annealing at or below 400° C., similar to the as-quenched sample (expressed as as-Q in FIGS. 5 and 6), but it decreases by annealing at 450° C. The saturation magnetization of the sample having a thickness of 229 μm reaches a maximum by annealing at 400° C. and decreases by annealing at higher temperatures. In order to clarify this phenomenon, X-ray diffraction patterns of this sample before and after annealing at 400° C. for 10 minutes were compared.

Figure 7:
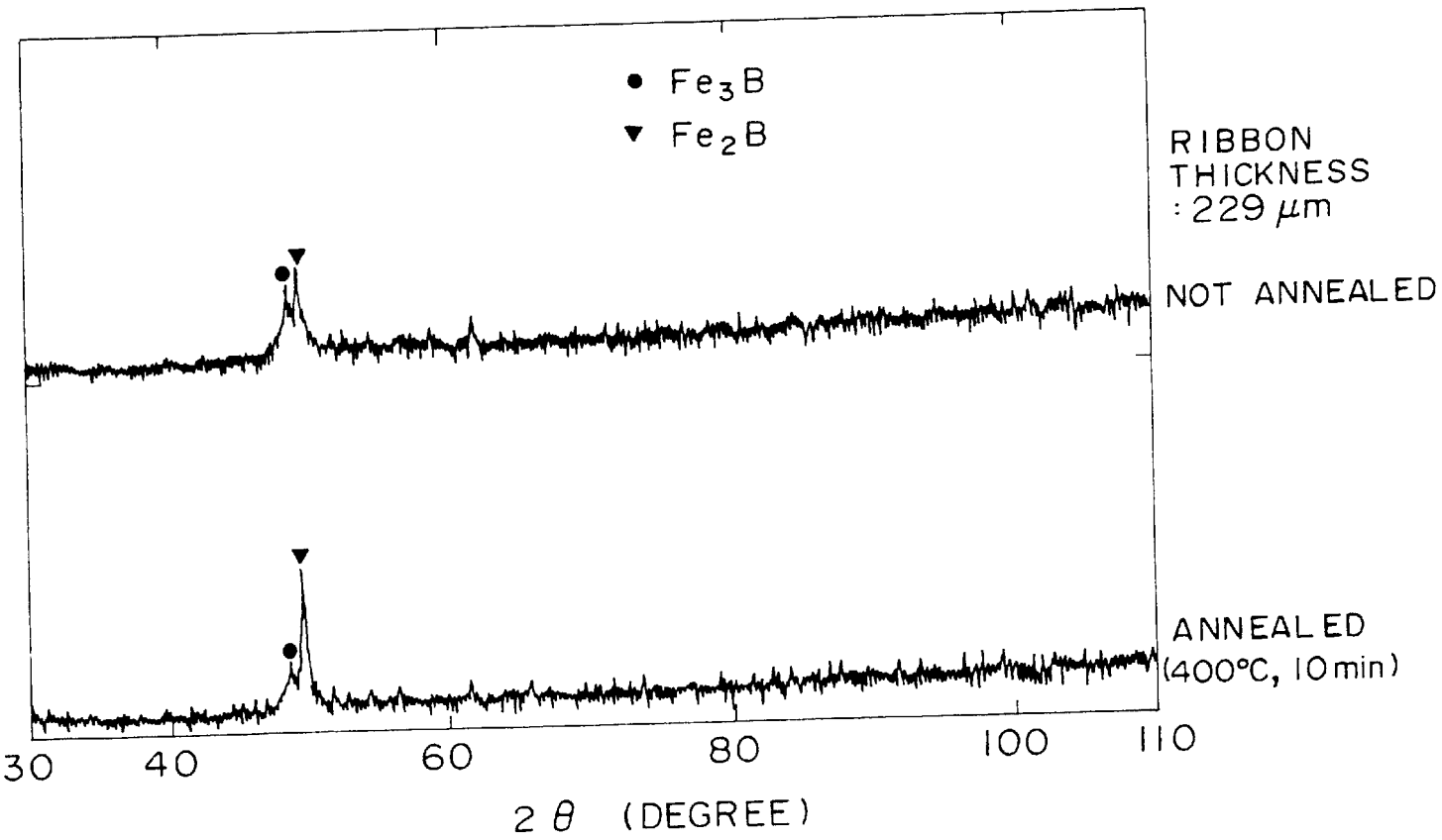
FIG. 7 is a graph illustrating X-ray diffraction patterns of a sample having a thickness of 229 $\mu$m before and after annealing.

FIG. 7 is a graph illustrating this comparison. The diffraction pattern before annealing has two peaks of almost the same intensity near 2θ=50°, which are considered to be assigned to $Fe_2B$ and $Fe_3B$ crystal grains, whereas the peak assigned to the $Fe_2B$ crystal grains has a higher intensity in the sample after annealing. These results suggest that only the $Fe_2B$ crystal grains grow by annealing at a lower temperature. Saturation magnetization deterioration by annealing at over 400° C. is probably due to $Fe_3B$ crystal grain growth. The saturation magnetization ($\sigma_s$) of two samples each having a thickness 151 μm or 180 μm does not change by annealing at or below 400° C. and this suggests that only $Fe_2B$ crystal grains, which are present before annealing, grow by annealing at or below 400° C., and other crystal grains also grow by annealing at a higher temperature.

The coercive force (Hc) improves and reaches a minimum by annealing at 350° C. in all samples. At an annealing temperature higher than 350° C., the coercive force increases with annealing temperature. In each sample having a thickness of 151 or 180 μm, which is supposed to include crystal grains before annealing, the coercive force is slightly higher compared to samples of a single amorphous structure. Coercive force is indeterminable for the sample having a thickness of 229 μm.

The permeability of each sample is improved by annealing and reaches a maximum after annealing at 350° C.

Figure 8:
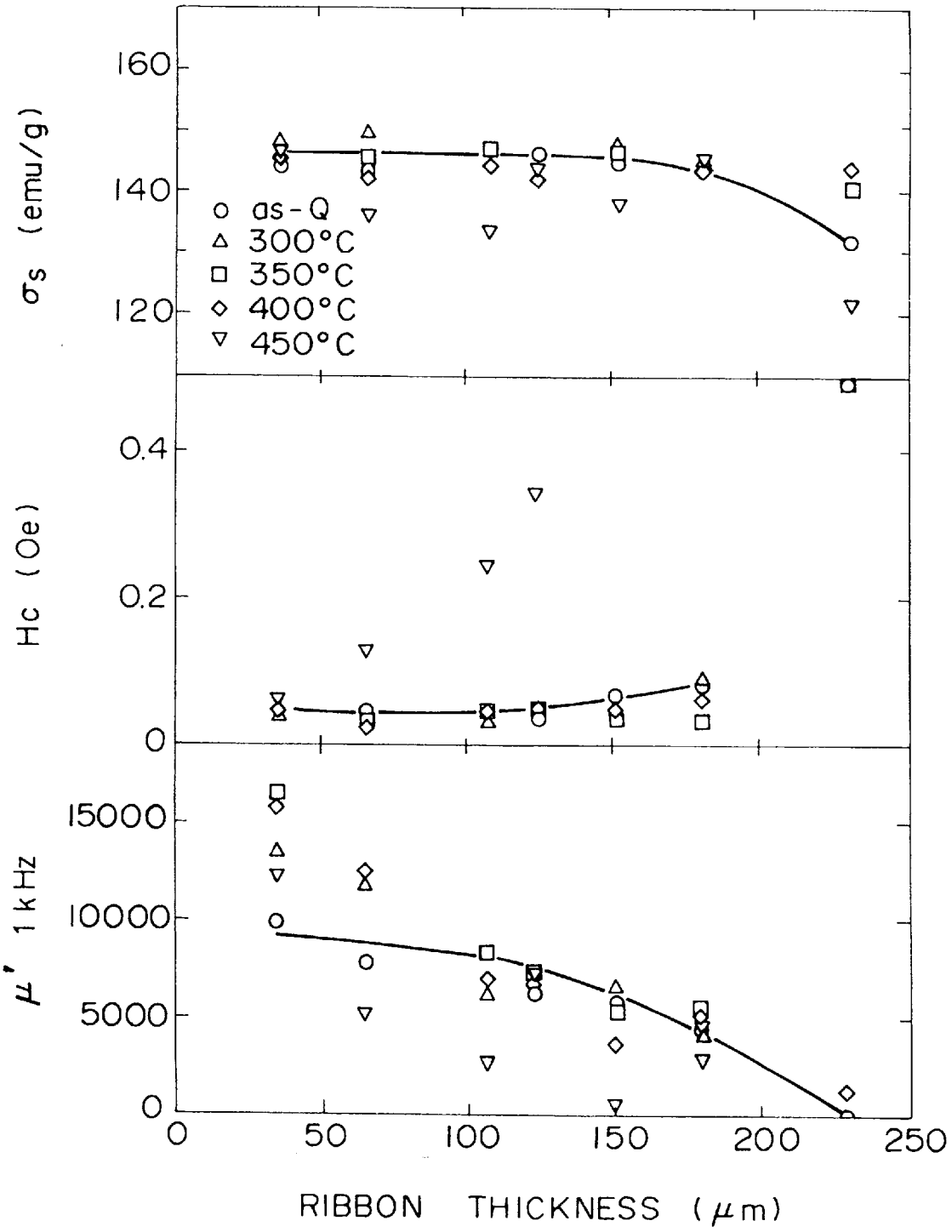
FIG. 8 is a graph illustrating changes at various thicknesses in saturation magnetization, coercive force and permeability of samples annealed at different temperatures.
Figure 9:
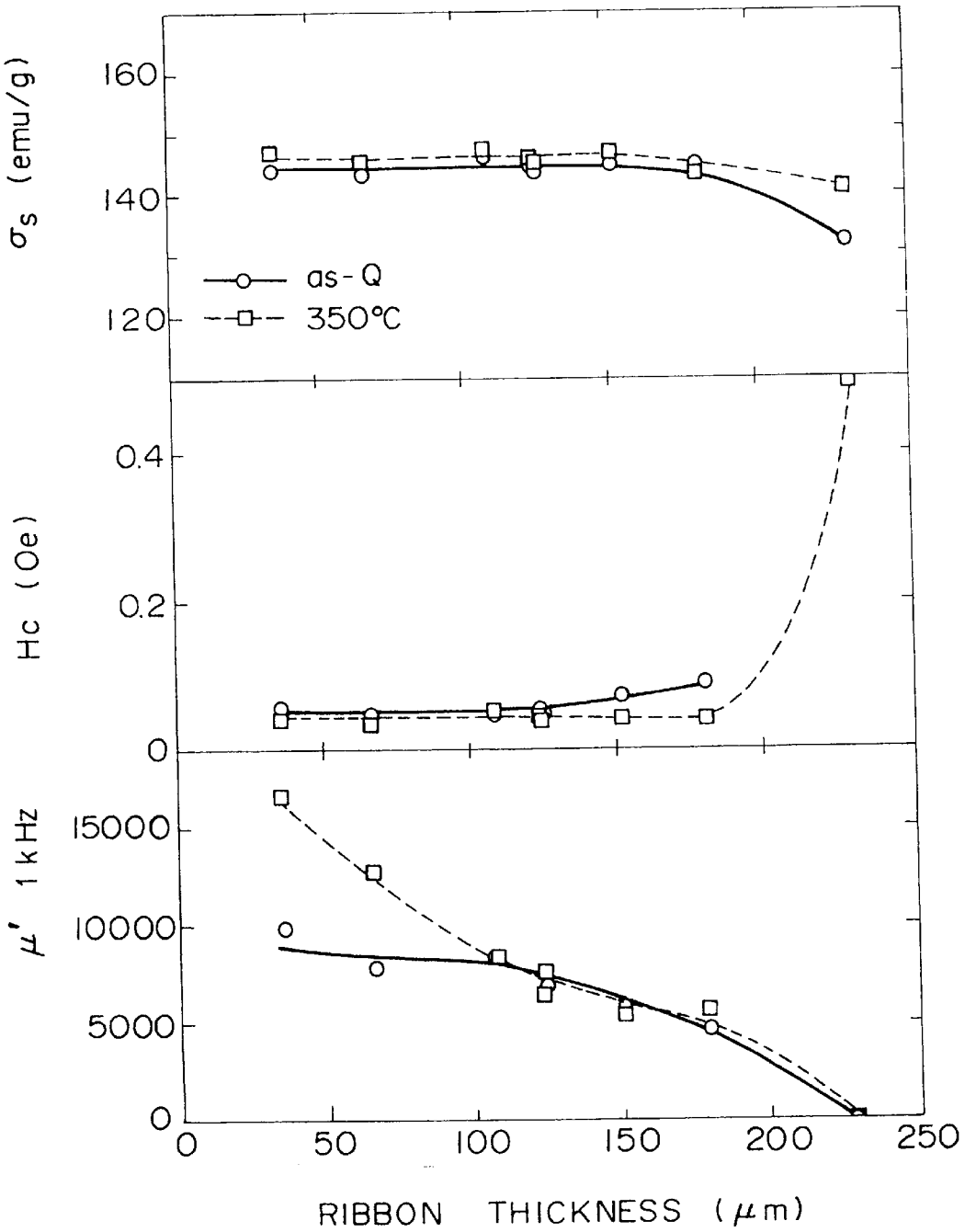
FIG. 9 is a graph based on data partially extracted from FIG. 8.

FIG. 8 is a graph illustrating the dependence of magnetic characteristics on the thickness of each sample after annealing at different temperatures. FIG. 9 is a graph including data of a sample before annealing and after annealing at 350° C. which was extracted from FIG. 8 in order to clarify annealing effects. FIGS. 8 and 9 demonstrate that saturation magnetization $\sigma_s$ does not change before annealing in each sample having a thickness of no greater than 180 $\mu$m, whereas it deteriorates in thicker samples. The coercive force (Hc) is almost constant before annealing in each sample having a thickness of no greater than 125 $\mu$m which comprises a single amorphous structure, whereas it increases in thicker samples. The coercive force decreases by annealing at or below 400° C. The permeability ($\mu'$) at 1 kHz is almost constant before annealing in each sample having a thickness of no greater than 125 $\mu$m which comprises a single amorphous structure, whereas it decreases in thicker samples. The permeability increases by annealing at or below 400° C., such an increase does not noticeably change with thickness. The permeability greatly decreases by annealing at 450° C.

Such changes in magnetic characteristics by annealing is probably due to thermal relaxation of internal stresses present in the sample before annealing. These experimental results suggest that an optimum annealing temperature $T_a$ is approximately 350° C. Since magnetic characteristics may deteriorate by annealing at a temperature lower than he Curie temperature $T_c$ due to magnetic domain adhesion, the annealing temperature must be not less than 300° C. The magnetic characteristics after annealing at 450° C. (very near the crystallization temperature of 500° C.) are inferior compared to those before annealing, probably due to crystal nucleus formation (ordering of low order structure) or domain wall pinning due to the crystal nucleus formation. Thus, it is preferable that the annealing temperature be between 300 and 500° C., in other words, between 300 and the crystallization temperature, and more preferably between 300 and 450° C.

The results of saturation magnetization ($\sigma_s$) coercive force (Hc) and permeability ($\mu'$) of samples having different thicknesses are shown in Table 2 with their microstructures. The microstructure was determined by X-ray diffractometry (XRD) and amor. in the table indicates a single amorphous phase and amor.+crys. indicates a mixed amorphous and crystal phase.

TABLE 2

| Thickness ($\mu$m) | $\sigma_g$ (emu/g) | Hc (Oe) | $\mu$ (1kHz) | $\Delta T_x$ (°C.) | Structure (XRD) |
|---|---|---|---|---|---|
| 108 | 146.7 | 0.057 | 8280 | 48.073 | amor. |
| 151 | 145.2 | 0.048 | 5786 | 46.801 | amor. + crys. |
| 66 | 143.7 | 0.047 | 7724 | 47.455 | amor. |
| 124 | 144.7 | 0.054 | 6750 | 46.887 | amor. |
| 135 | 144.0 | 0.047 | 6863 | 47.279 | amor. |
| 35 | 144.1 | 0.072 | 9769 | 47.719 | amor. |
| 180 | 145.0 | 0.089 | 4627 | 46.405 | amor. + crys. |
| 229 | 132.6 | — | 32 | 41.358 | amor. + crys. |

amor.: amorphous, crys.: crystal

Figure 10:
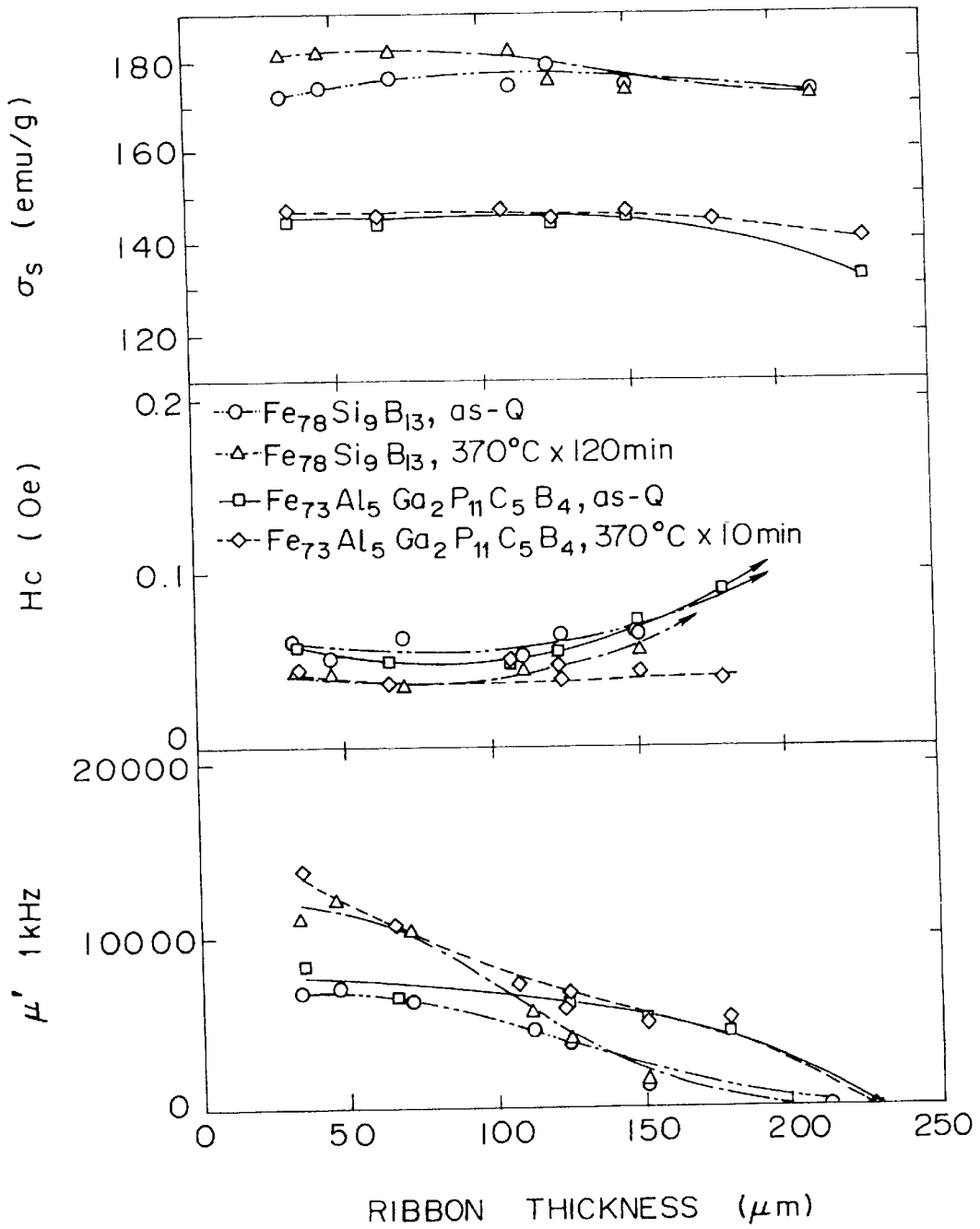
FIG. 10 is a graph illustrating changes at various thicknesses in saturation magnetization, coercive force and permeability of samples having different compositions.

FIG. 10 is a graph illustrating the dependence of saturation magnetization ($\sigma_s$) , coercive force (Hc) and permeability ($\mu'$) on thickness of a sample for comparison having a composition of $Fe_{78}Si_9B_{13}$ before and after annealing at 370° C. for 120 minutes, and a sample in accordance with the present invention having a composition of $Fe_{73}Al_5Ga_2P_{11}C_5B_4$ before and after annealing at 350° C. for 10 minutes. Both samples exhibit excellent magnetic characteristics without deterioration in a thickness range between 30 and 200 $\mu$m.

Figure 11:
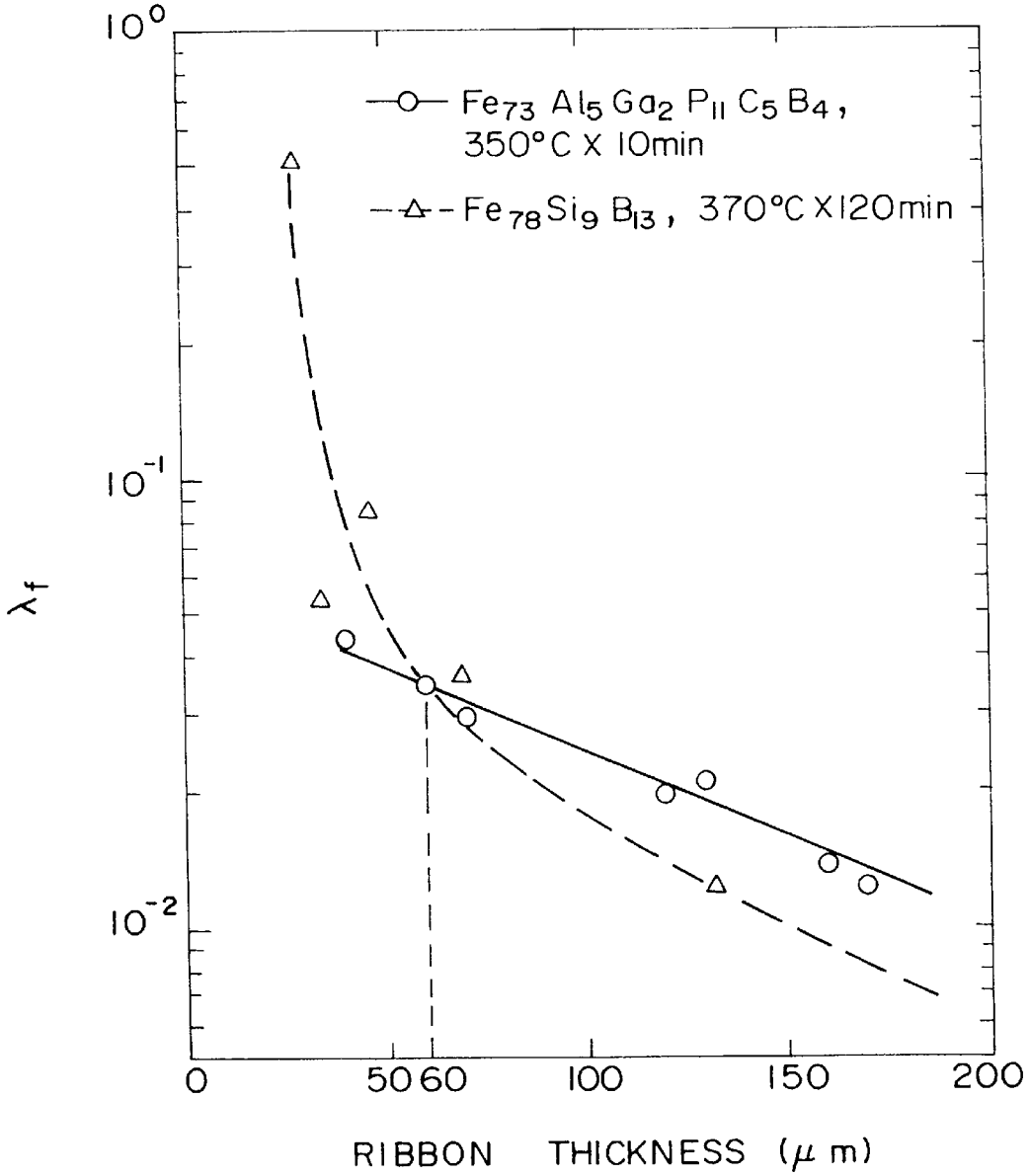
FIG. 11 is a graph illustrating correlation between maximum distortion and thickness of samples having different compositions.

FIG. 11 is a graph illustrating maximum strain by a bending test of a sample for comparison having a composition of $Fe_{78}Si_9B_{13}$ after annealing at 370° C. for 120 minutes, and a sample having a composition of $Fe_{73}Al_5Ga_2P_{11}C_5B_4$ after annealing at 350° C. for 10 minutes. The bending test was performed as follows: A thin ribbon is intercalated between the tips of a pair of parallel rods and bent by gradually bringing the pair of rods together. The distance L between the rod tips when the thin ribbon broke was measured. The maximum strain ($\lambda_f$) is defined as t/(L-t), where t indicates thickness of the thin ribbon. FIG. 11 shows that the $Fe_{78}Si_9B_{13}$ sample for comparison drastically loses maximum strain with increasing thickness, in other words, becomes more brittle, whereas the decrease in maximum strain is suppressed, in other words, embrittlement is suppressed in the $Fe_{73}Al_5Ga_2P_{11}C_5B_4$ sample in accordance with the present invention. At a thickness larger than 60 $\mu$m, the sample in accordance with the present invention is more resistive to bending than the sample for comparison.

Figure 12:
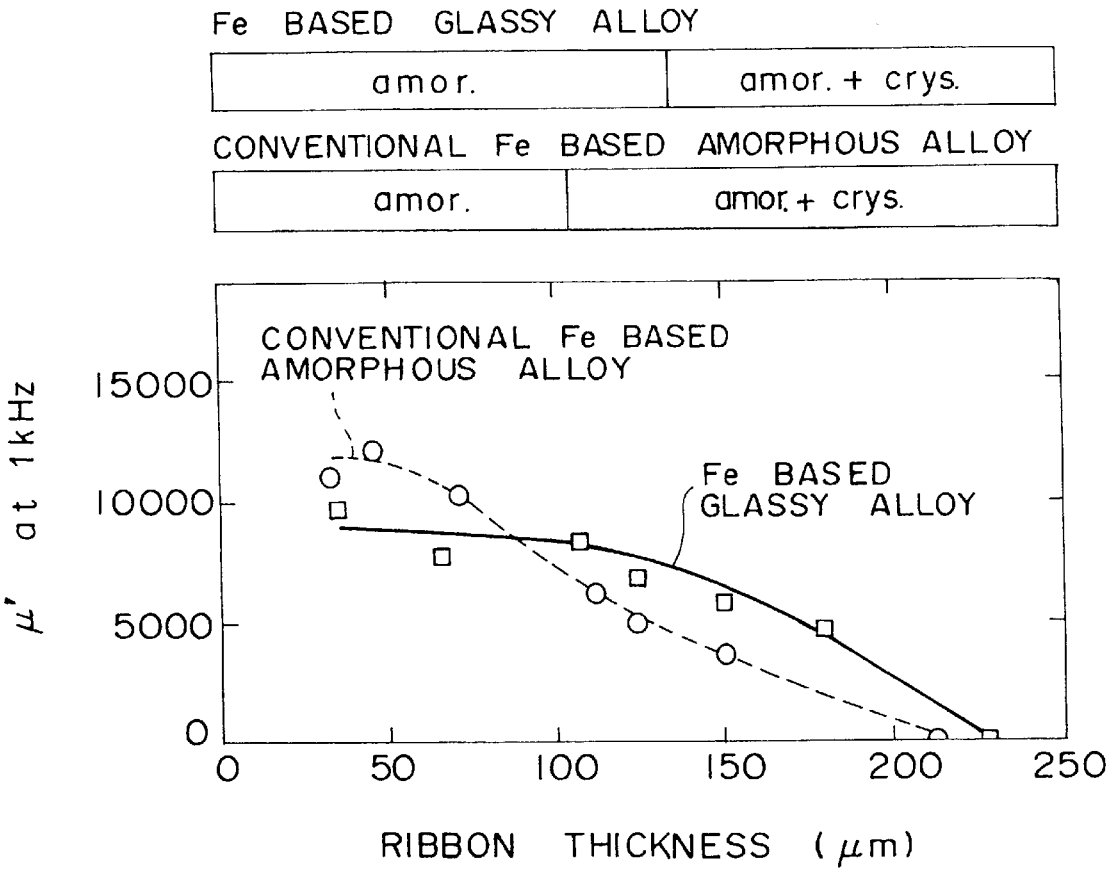
FIG. 12 is a graph illustrating the dependence of permeability on thickness of a conventional Fe based amorphous material and a glassy alloys having a composition in accordance with the present invention.

FIG. 12 is a graph for comparing the dependence of permeability on thickness of a conventional Fe based amorphous alloy having a composition of $Fe_{78}Si_9B_{13}$ with that of a Fe based glassy alloy having a composition of $Fe_{73}Al_5Ga_2P_{11}C_5B_4$ in accordance with the present invention. FIG. 12 shows that the permeability of the glassy alloy in accordance with the present invention is high in a thickness range of no greater than 60 $\mu$m, and is higher in a thickness range of not less than 80 $\mu$m compared with that of the conventional alloy. In order to achieve excellent soft magnetic characteristics, i.e., a permeability higher than 5,000, it is preferable that the thickness be in a range between 20 and 180 $\mu$m.

Figure 13:
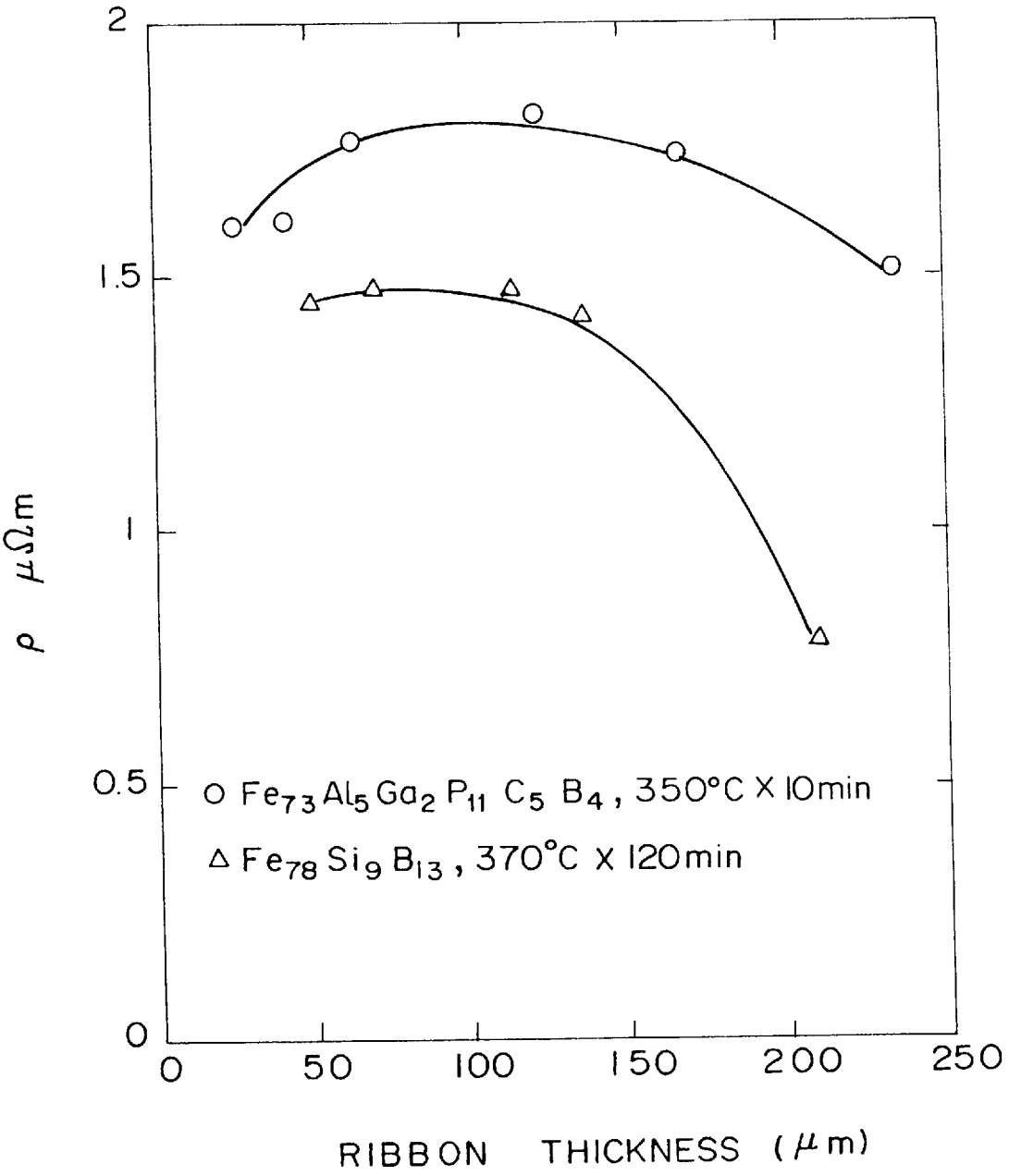
FIG. 13 is a graph illustrating the dependence of resistivity on thickness of a conventional Fe based amorphous material and a glassy alloy having a composition in accordance with the present invention.

FIG. 13 is a graph illustrating the dependence of resistivity on thickness of a sample for comparison having a composition of $Fe_{78}Si_9B_3$ and a sample having a composition of $Fe_{73}Al_5Ga_2P_{11}C_5B_4$ in accordance with the present invention. The sample in accordance with the present invention exhibits a resistivity of not less than 1.5 $\mu\Omega$cm over a thickness range between 18 and 235 $\mu$m, and is higher than the sample for comparison. Thus, the glassy alloy in accordance with the present invention can exhibit low eddy current loss at high frequencies.

Example 2

A series of ribbon samples having different Fe contents and expressed by the stoichiometric formula $Fe_{70+x}Al_5Ga_2(P_{55}C_{25}B_{20})_{23-x}$ were prepared to evaluate microstructure and magnetic characteristics, according to the method set forth in Example 1. Each ribbon sample was adjusted to a thickness of 30 $\mu$m.

Figure 14:
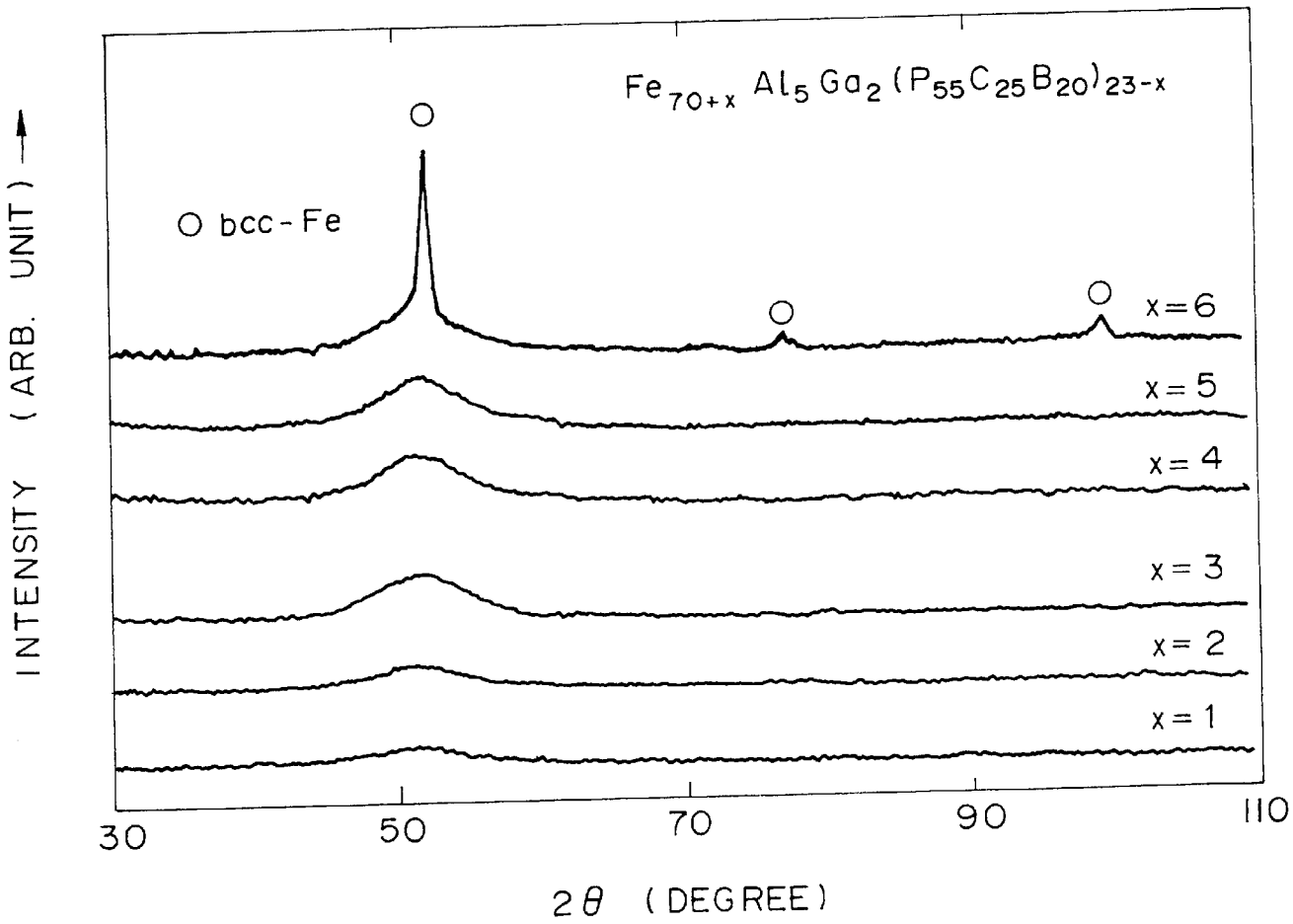
FIG. 14 is a graph including X-ray diffraction patterns of samples containing 71 to 76 atomic percent of Fe.

FIG. 14 includes X-ray diffraction patterns of the resulting samples. As shown in FIG. 14, samples having Fe contents between 71 and 75 atomic percent (X=1 to 5 in the stoichiometric formula) exhibit halo patterns and thus are composed of a single amorphous phase microstructure. On the other hand, the sample containing 76 atomic percent of Fe (x=6 in the stoichiometric formula) exhibits sharp diffraction peaks (marked with ○ in the figure) probably due to bcc-Fe crystal formation.

Figure 15:
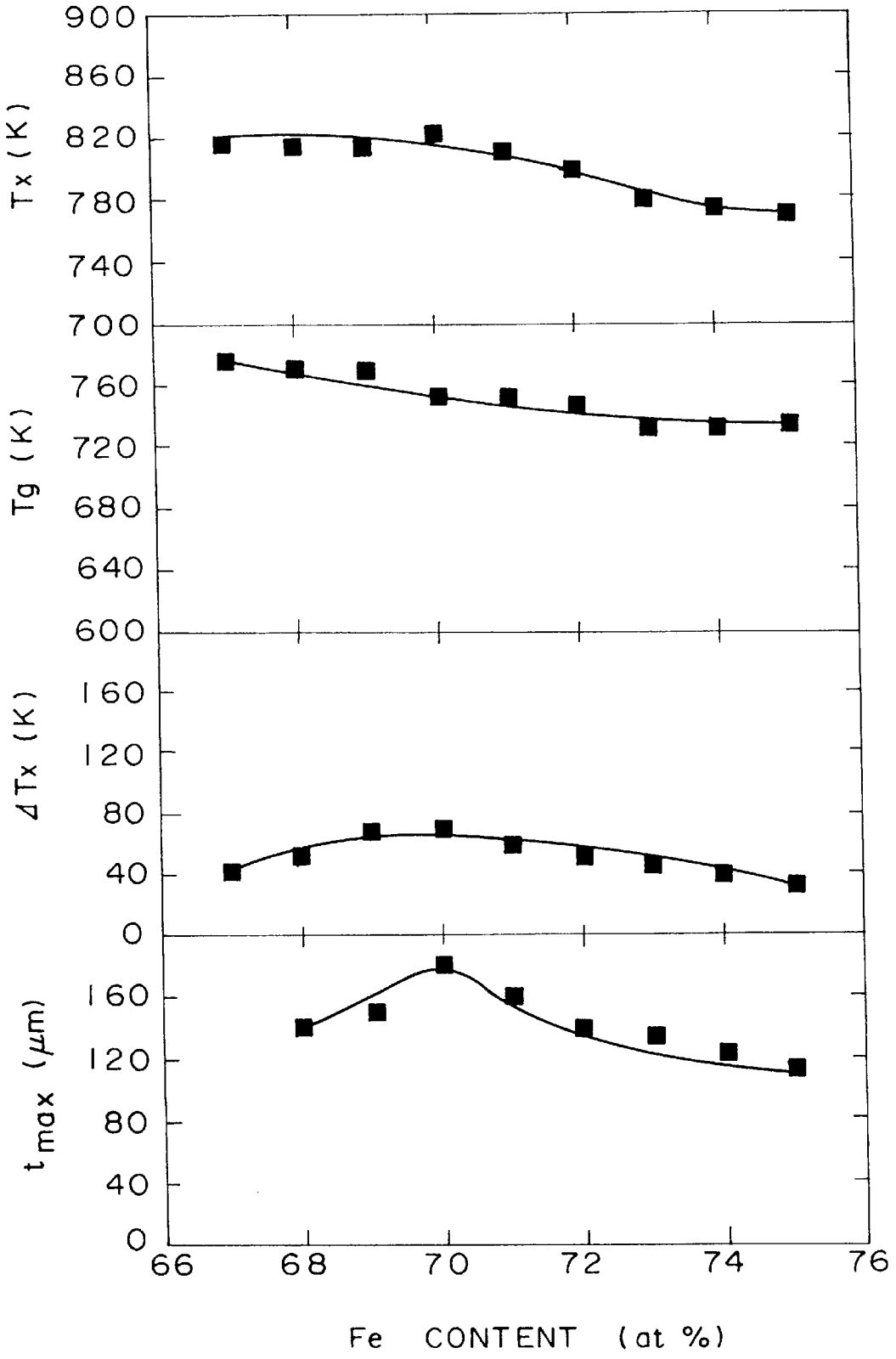
FIG. 15 includes graphs illustrating the dependence of crystallization temperature $T_x$, glass transition temperature $T_g$, $\Delta T_x$ and $t_{max}$ on Fe content.

FIG. 15 is a graph illustrating the dependence of $T_x$ and $T_g$ on Fe content of a series of samples expressed by the stoichiometric formula $Fe_{67+x}$, $Al_5Ga_2(P_{55}C_{25}B_{20})_{26-x'}$, in which $T_x$ and $T_g$ were determined from their respective DSC thermograms (not shown in the figure). The thickness of each sample was 30 $\mu$m. FIG. 15 shows that the $T_x$ decreases with Fe content over a Fe content range between 67 and 75 atomic percent (x'=0 to 8 in the stoichiometric formula). $T_g$ also decreases with Fe content. $\Delta T_x$ determined from $T_x$ and $T_g$ ranges from 35 to 70° C. The $t_{max}$ value or maximum thickness, obtainable for a ribbon composed entirely of amorphous phase, has a peak at 70 atomic percent of Fe, is not less than 150 μm at 69 to 71 atomic percent of Fe, and not less than 110 μm at 67 to 75 atomic percent.

Figure 16:
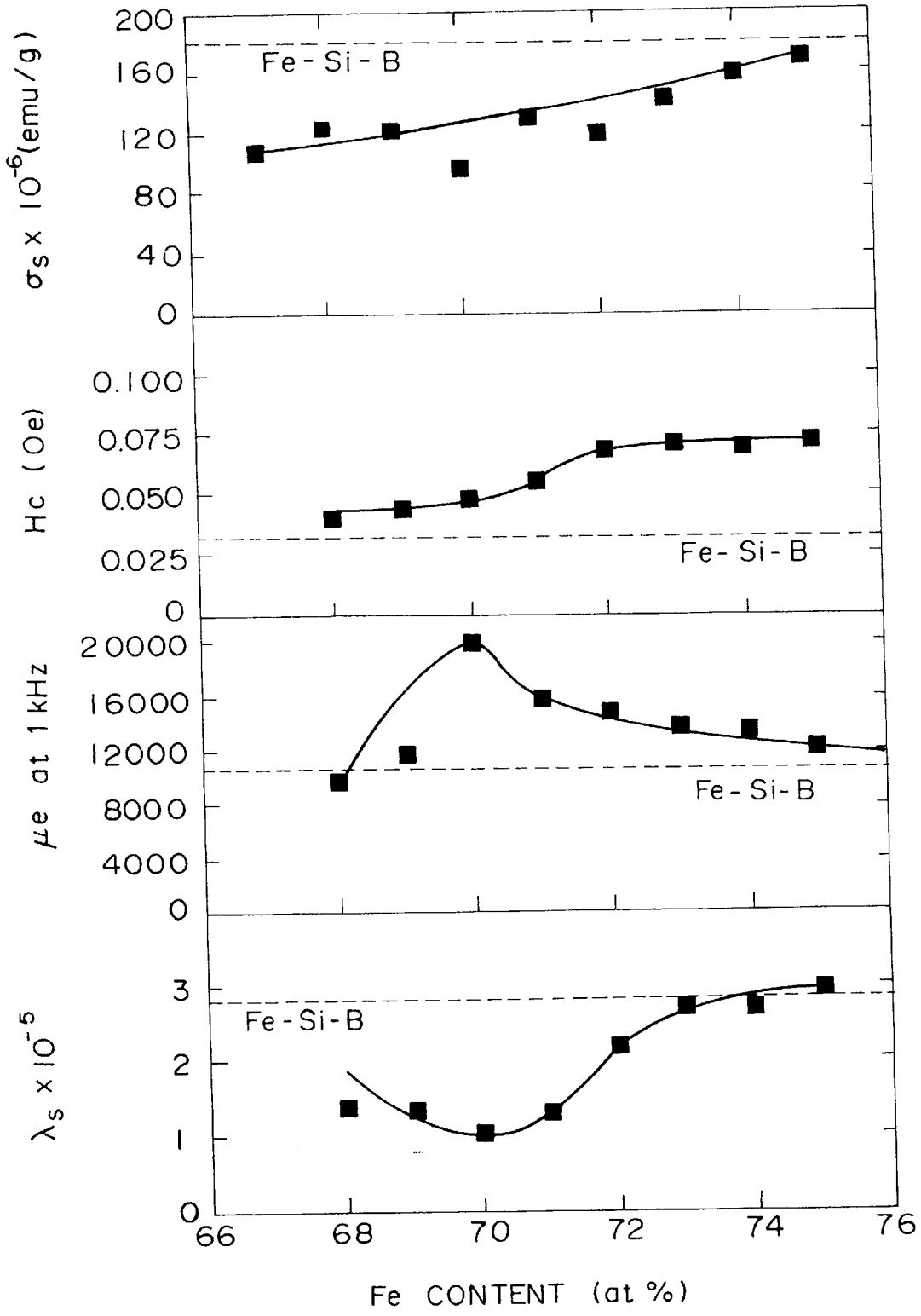
FIG. 16 includes graphs illustrating the dependence of saturation magnetization, coercive force, permeability and magnetostriction on Fe content.

FIG. 16 is a graph illustrating magnetic characteristics of ribbon samples expressed by the stoichiometric formula $Fe_{67+x}$, $Al_5Ga_2(_{55}C_{25}B_{20})_{26-x}$ after annealing of a heating rate 180° C./sec., a holding temperature of 350° C., and a holding time of 30 minutes. FIG. 16 also shows magnetic characteristics (broken lines) of a conventional $Fe_{78}Si_9B_{13}$ amorphous alloy ribbon having a thickness of 25 μm after annealing at 370° C. for 120 minutes in vacuo for comparison. FIG. 16 demonstrates that the saturation magnetization ($\sigma_s$) increases with Fe content. The saturation magnetization is 150 emu/g at 71 atomic percent of Fe and is almost the same as the Fe-Si-B based sample ($\sigma_e$=183 emu/g) for comparison.

The coercive force (Hc) is almost constant up to a Fe content of 75 atomic percent of which a single amorphous phase microstructure can be achieved.

The sample has a permeability ($\mu'$) at 1 kHz of approximately 20,000 for a Fe content of 70 atomic percent, of not less than 15,000 for a Fe content of 69 to 72 atomic percent, and of not less than 11,000 for a Fe content of 69 to 76 atomic percent. Thus, the samples in accordance with the present invention exhibit superior soft magnetic characteristics than the conventional amorphous sample for comparison.

Further, the samples in accordance with the present invention exhibit superior magnetostriction for a Fe content of between 68 and 74 atomic percent than the conventional amorphous alloy and exhibits the same value for a Fe content of 75 atomic percent.

As a result, the saturation magnetization can be improved by increasing the Fe content in the Fe based soft magnetic glassy alloy in accordance with the present invention, and a glassy alloy having a composition of $Fe_{70}Al_5Ga_2P_{12.65}C_{5.75}B_{4.6}$ and having almost the same saturation magnetization as the conventional Fe-Si-B based amorphous alloy can be produced by a single roll quenching process.

Figure 17:
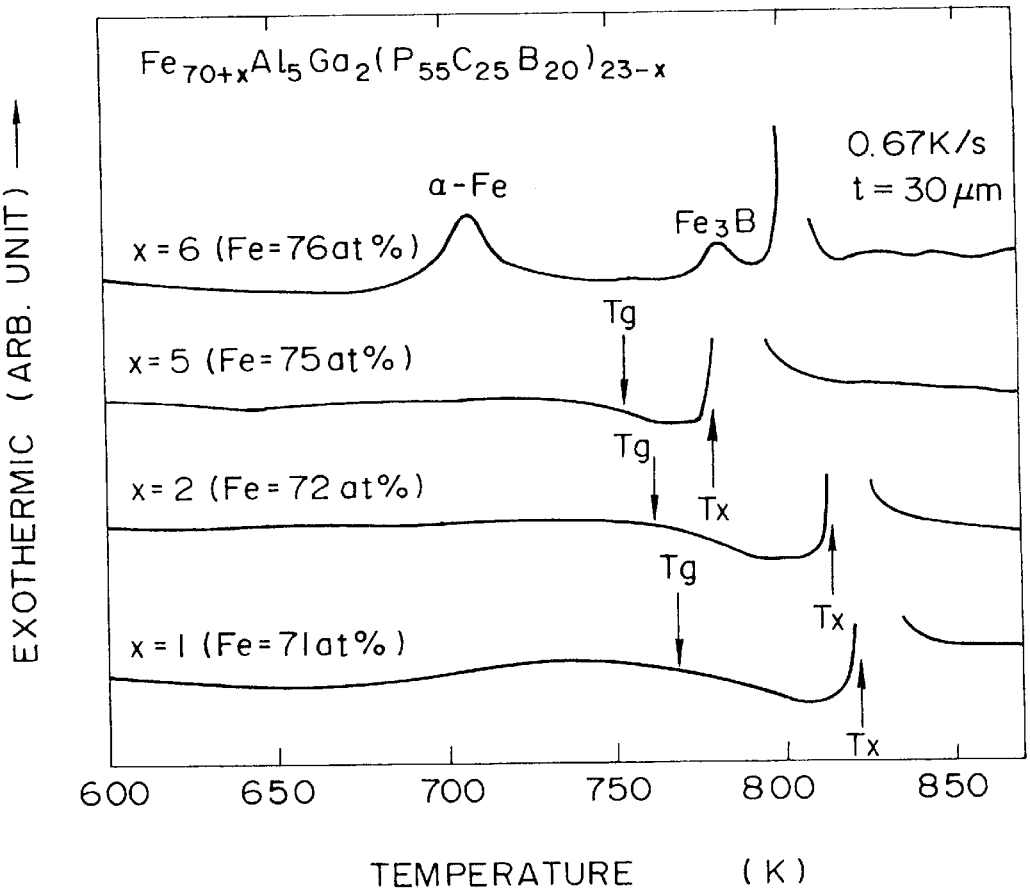
FIG. 17 includes DSC thermograms of samples having compositions of $Fe_{70+x}Al_5Ga_2(P_{55}C_{25}B_{20})_{23-x}$.

FIG. 17 shows DSC thermograms of samples having a thickness of 30 μn expressed by the stoichiometric formula $Fe_{70+x}A1_5$ $(P_{55}C_{25}B_{20})_{23-x}$,wherein x'1, 2, 5 or 6. DSC thermograms were obtained at a heating rate of 0.67° C./sec. FIG. 17 demonstrates that $T_g$ and $T_x$ increase and $\Delta T_x$ decreases with Fe content. Tg disappears at a Fe content of 76 atomic percent, and deposition of compound phase such as α-Fe and $Fe_3B$ phases is observed. Thus, the glassy alloy in accordance with the present invention has a supercooled liquid region for a Fe content of 75 atomic percent and high amorphous phase formability.

Example 3

Advantages of a Fe based soft magnetic glassy alloy having a composition set forth in Example 1 and further containing Si will be described in this example.

An alloy ingot having a composition of $Fe_{72}Al_5Ga_2P_{10}C_6B_4Si_1$ was prepared and melted in a crucible. The melt was injected on a rotating roll through a crucible nozzle in a reduced pressure Ar atmosphere (−10 cmHg), at a nozzle diameter of 0.4 to 0.5 mm, a distance (gap) between the nozzle tip and the roll surface of 0.3 mm, a roll rotation frequency of 200 to 2,500 rpm, an injection pressure of 0.35 to 0.40 kgf/cm$^2$, and a roll surface of #1,000. A series of quenched ribbons each having a thickness of 20 to 250 μm were prepared by such a single roll process. The side of the ribbon in contact with the roll surface is referred to as the roll side, and its rear side is referred to as the free side.

Figure 18:
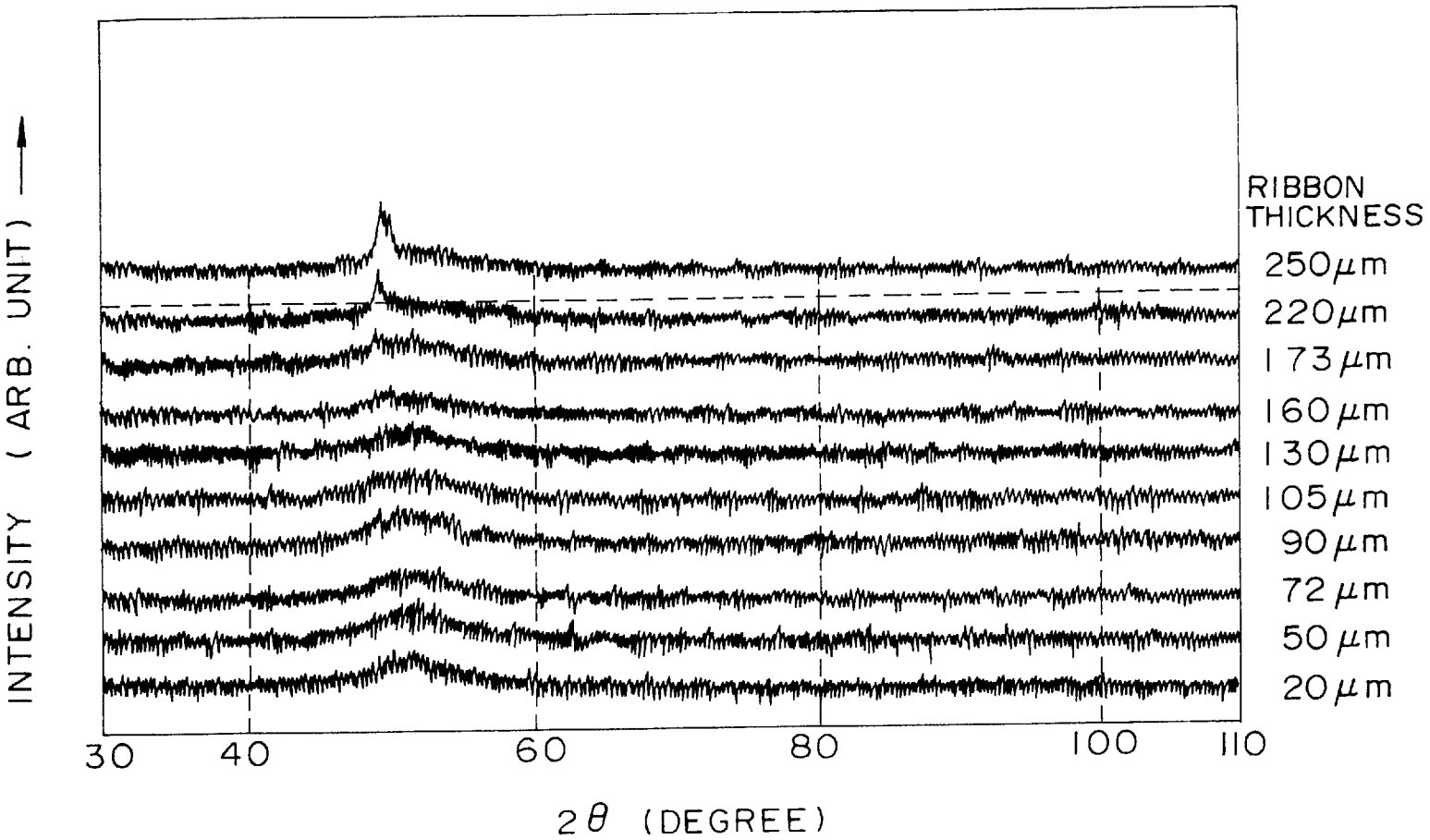
FIG. 18 is a graph illustrating X-ray diffraction patterns of samples containing Si and having various thicknesses between 20 $\mu$m and 250 $\mu$m.

FIG. 18 shows X-ray diffraction patterns of the free side of the resulting ribbon samples. As demonstrated in FIG. 18, each sample having a thickness between 20 and 160 μm has a halo pattern at 2θ=40 to 60° indicating a single amorphous phase microstructure. In each sample having a thickness of not less than 170 μm, a sharp diffraction peak was observed at approximately 2θ=50°. It is considered that this peak is assigned to a $Fe_3C$ and $Fe_3B$ crystal phase.

The results set forth above demonstrate that ribbons having a thickness between 20 and 160 μm and a single amorphous phase microstructure can be prepared by a single roll process. In Example 1 set forth above, a single amorphous phase microstructure can be formed in a glassy alloy ribbon having a thickness of no greater than approximately 135 μm, and a peak due to crystal grain precipitation is observed from a glassy alloy ribbon having a thickness of 151 μm. Thus, addition of Si evidently increases the critical thickness in which a single amorphous phase microstructure can be formed.

Figure 19:
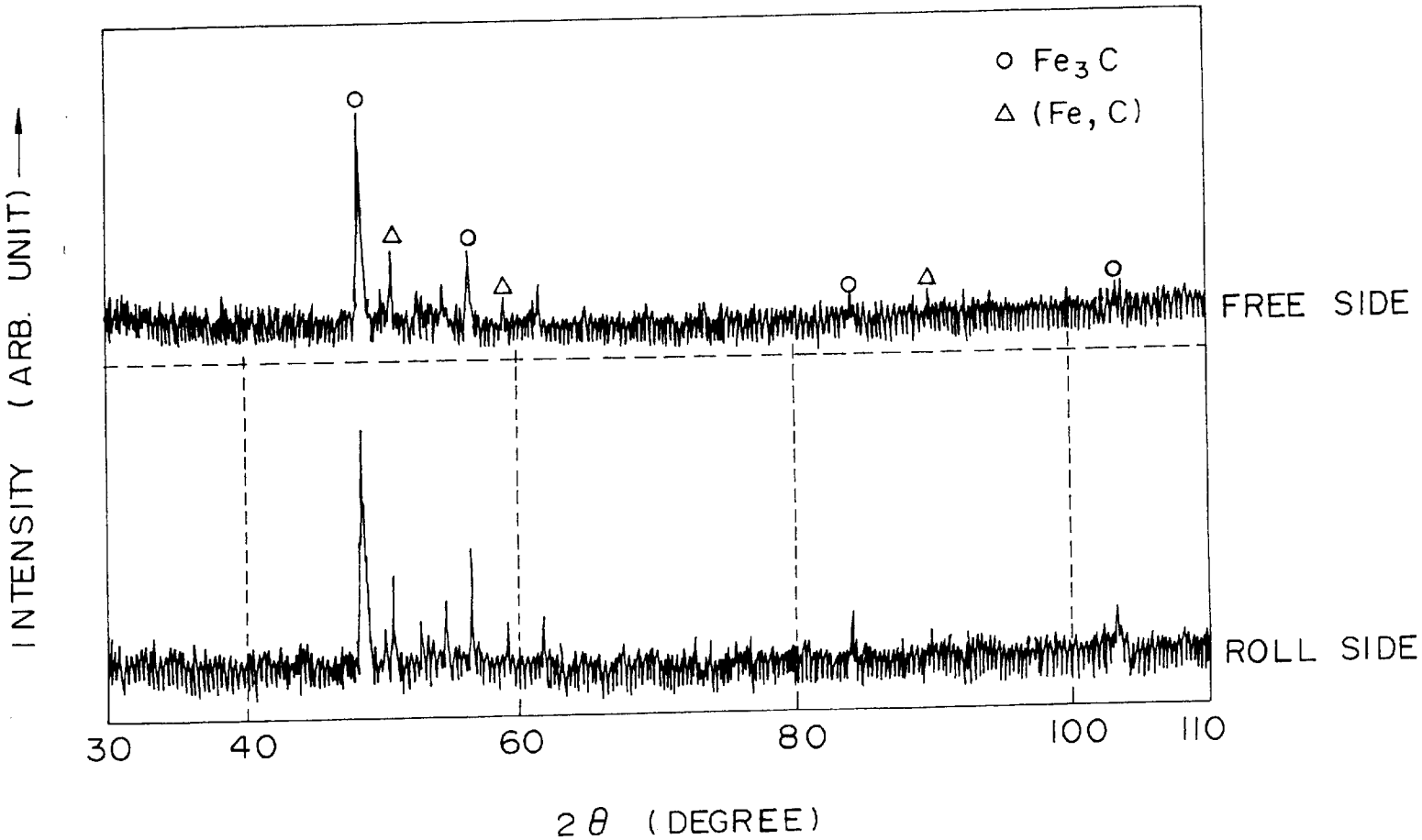
FIG. 19 is a graph illustrating X-ray diffraction patterns of a sample containing Si and having a thickness of 470 $\mu$m.

FIG. 19 shows X-ray diffraction patterns of the roll and free sides of a ribbon sample (not annealed) having the same composition ($Fe_{72}Al_5Ga_2P_{10}C_6B_4Si_1$) as above and a thickness of approximately 470 μm. Although an amorphous phase can easily be formed in Si-containing alloys, both the free and roll sides are crystallized in this sample having a thickness over the critical thickness.

Figure 20:
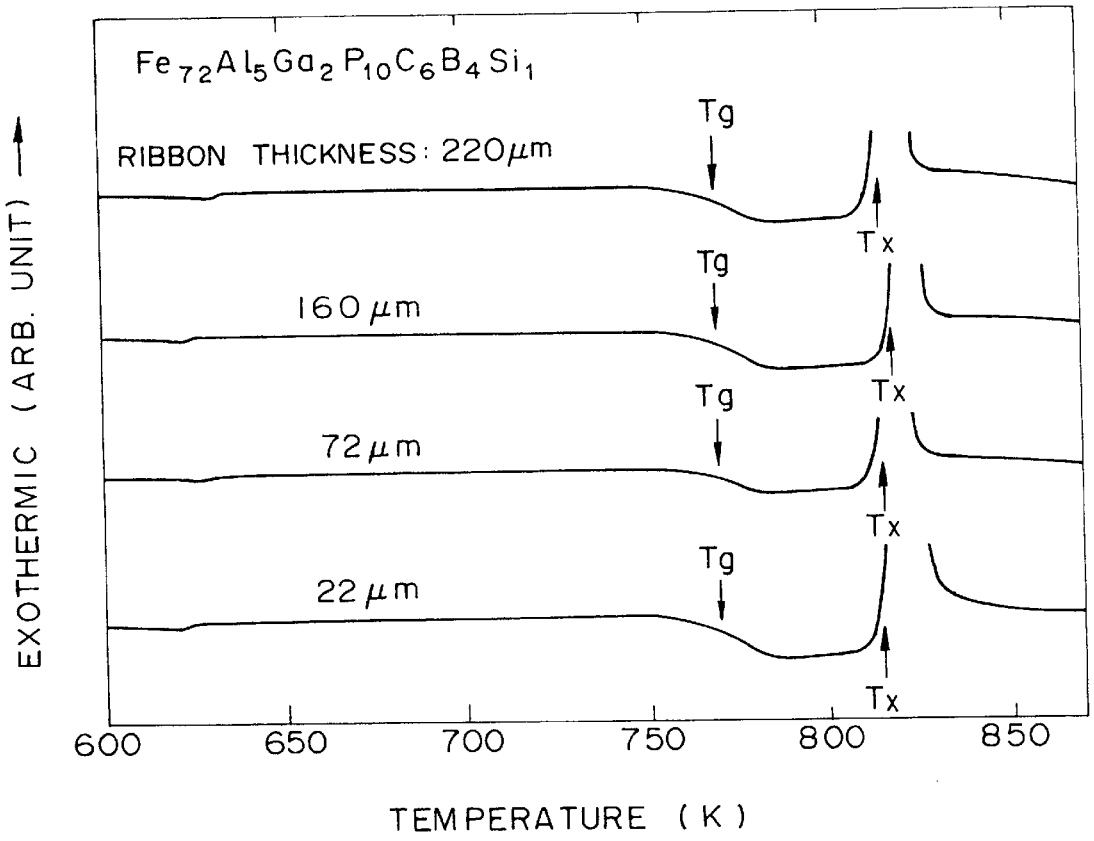
FIG. 20 include DSC thermograms of Si-containing samples.

FIG. 20 shows DSC thermograms of ribbon samples each having a thickness between 22 and 220 μm, at a heating rate of 0.67° C./sec. FIG. 20 demonstrates that each alloy has a supercooled liquid region over a wide temperature range below the crystallization temperature or a large $\Delta T_x$ value ($=T_x-T_g$) as in Example 1. Thus, these alloys evidently have high amorphous phase formability.

Figure 21:
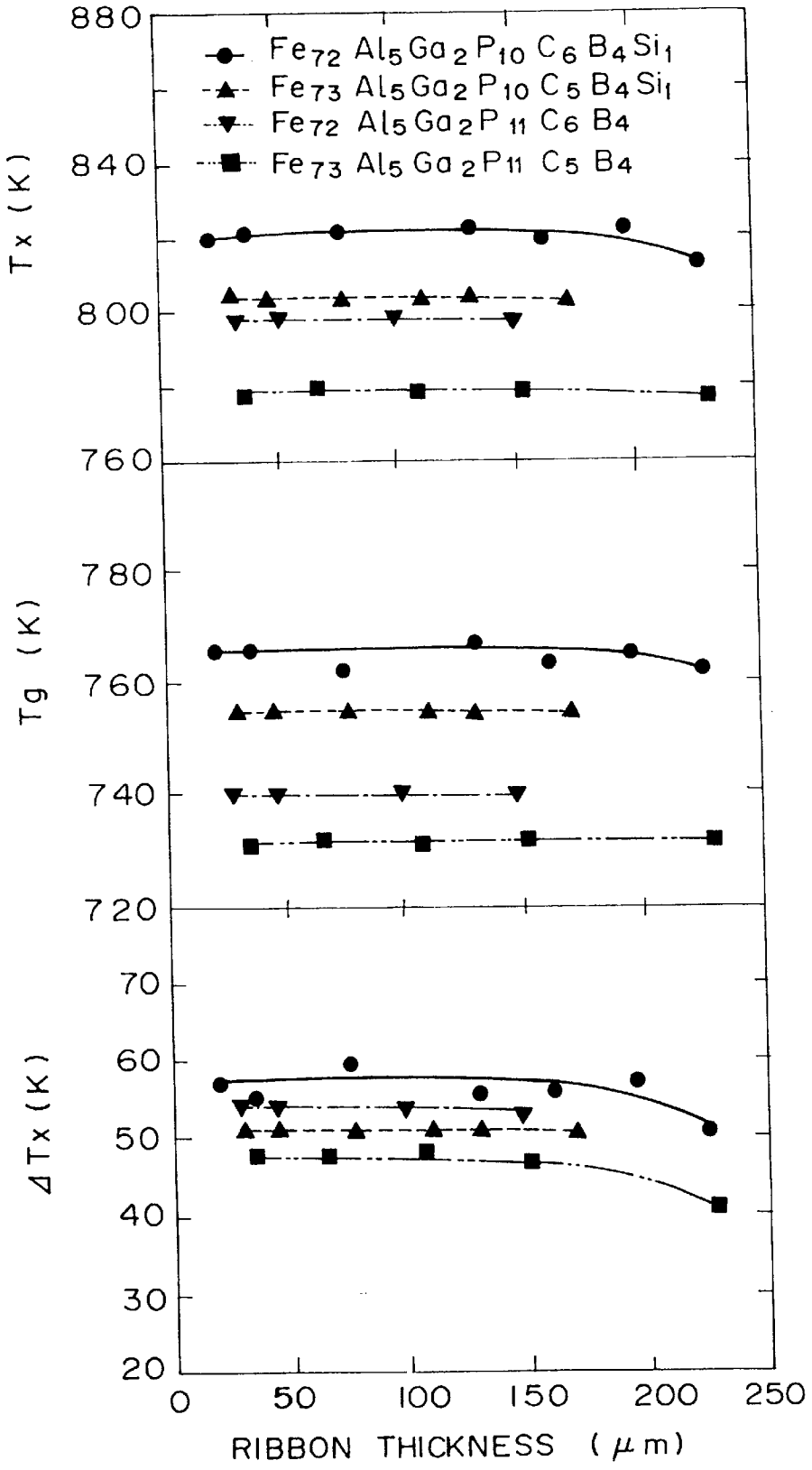
FIG. 21 includes graphs illustrating the dependence of crystallization temperature $T_x$, glass transition temperature $T_g$, and $\Delta T_x$ on thickness.

FIG. 21 shows the correlation between $T_x$, $T_g$ or $\Delta T_x$ and thickness of Si-free alloy samples and Si-containing alloy samples. $T_x$, $T_g$ and $\Delta T_x$ were each determined from DSC thermograms of two Si-free samples, i.e., $Fe_{72}Al_5Ga_2P_{11}C_6B_4$ (▼) and $Fe_{73}Al_5Ga_2P_{11}C_5B_4$ (■), and two Si-containing samples, i.e., $Fe_{72}Al_5Ga_2P_{10}C_6B_4Si_1$ (●) and $Fe_{73}Al_5Ga_2P_{10}C_5B_4Si_1$ (▲), in which 1 atomic percent of P in the Si-free samples is replaced with Si in the Si-containing samples. FIG. 21 illustrates that none of $T_x$, $T_g$ and $\Delta T_x$ significantly change with thickness. The Si-containing samples $Fe_{72}Al_5Ga_2P_{10}C_6B_4Si_1$ and $Fe_{73}Al_5Ga_2P_{10}C_5B_4Si_1$ have $\Delta T_x$ values of approximately 57° C. and 51° C., respectively, whereas the Si-free samples $Fe_{72}Al_5Ga_2P_{11}C_6B_4$ and $Fe_{73}Al_5Ga_2P_{11}C_5B_4$ have $\Delta T_x$ values of approximately 54° C. and 47° C., respectively. Therefore, addition of Si increases $\Delta T_x$ by approximately 3 to 4° C.

Figure 22:
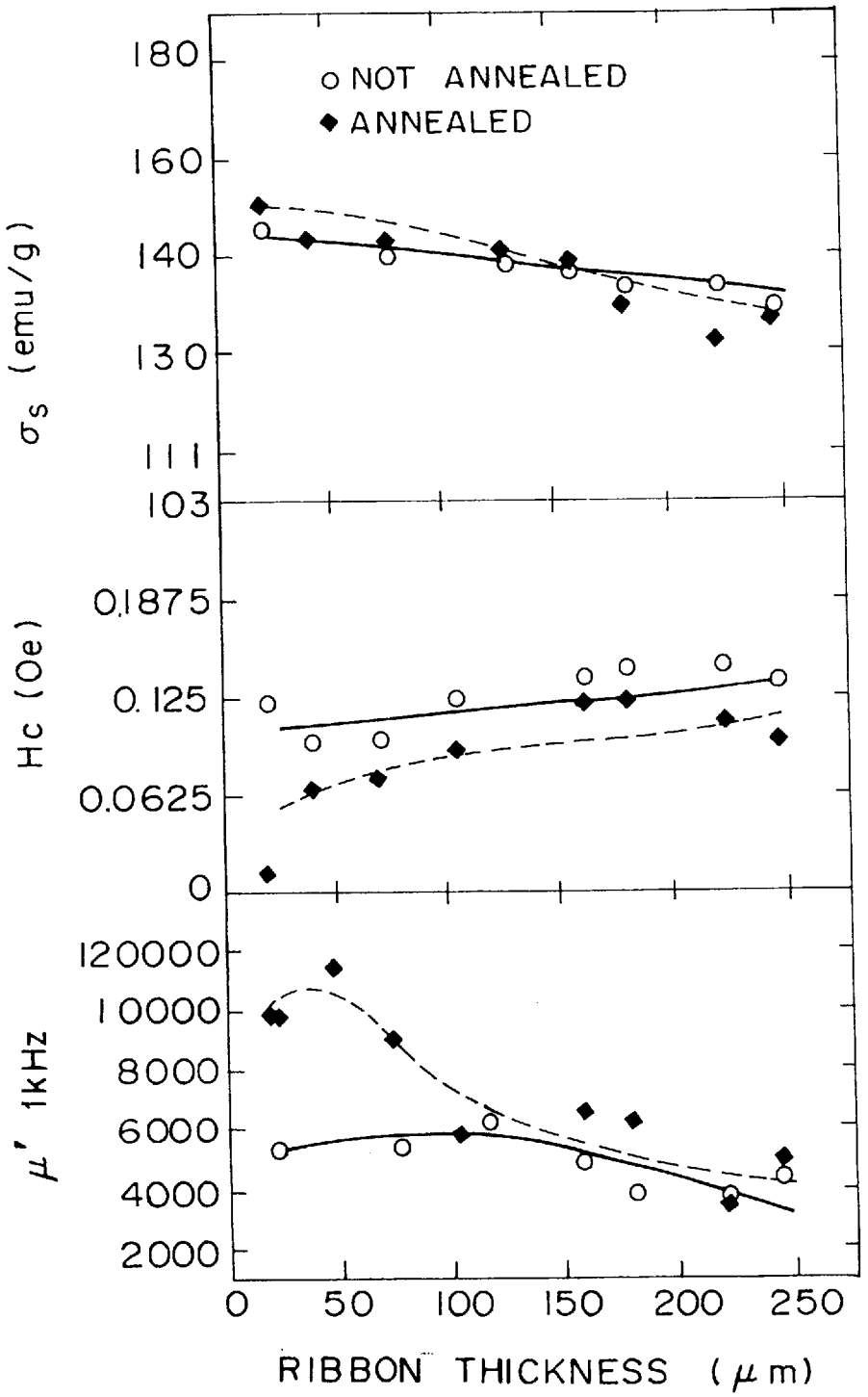
FIG. 22 includes graphs illustrating the dependence of saturation magnetization, coercive force and permeability on thickness of a Si-containing sample before and after annealing.

Magnetic characteristics of each ribbon sample having a thickness between 20 and 250 μm before annealing and after annealing were measured. FIG. 22 is a graph illustrating the dependence of magnetic characteristics on the thickness. Annealing was performed in vacuo using an infrared image furnace at a heating rate of 180° C./min., a holding temperature of 350° C. and a holding time of 30 minutes, in which the annealing conditions were the optimum conditions for the Si-free samples in Example 1.

FIG. 22 illustrates that the saturation magnetization ($\sigma_s$) before annealing is approximately 145 emu/g independent of thickness. The saturation magnetization does not substantially change by annealing at a thickness of 160 $\mu$m or less, and decreases by annealing at a thickness over than that. This is probably due to growth of crystal grains, such as $Fe_3B$ and $Fe_3C$.

The coercive force (Hc) before annealing increases with thickness. The coercive force after annealing is lower than that before annealing, and ranges from 0.635 to 0.125 Oe over the entire thickness region. Such a decrease in coercive force by annealing is probably due to relaxation of internal stresses by annealing as in Example 1. As a result of comparison of FIG. 22 with FIG. 9, the coercive force (Hc) of the Si-containing Fe based soft magnetic glassy alloy before annealing is higher than that of the Si-free glassy alloy over the entire thickness range. However, the coercive force of the Si-containing glassy alloy decreases by annealing to almost the same level as the Si-free glassy alloy.

The permeability ($\mu'$) at 1 kHz of each sample before annealing decreases with thickness. The permeability is improved by annealing and reaches almost the same level as that of the Si-free Fe based soft magnetic glassy alloy. The annealing effect decreases with thickness, similar to Example 1.

The results of saturation magnetization ($\sigma_s$), coercive force (Hc), permeability ($\mu'$) and microstructure of samples having various thicknesses are shown in Table 3. The microstructure was determined by XRD (X-ray diffractometry). In Table 3, amor. indicates an amorphous phase, and amor.+crys. indicates an amorphous and crystal mixed phase.

TABLE 3

| Thickness ($\mu$m) | Hc (Oe) | $\sigma_g$ (emu/g) | $\mu'$ (1kHz) | $\Delta T_x$ (°C.) | Structure (XRD) |
|---|---|---|---|---|---|
| 20 | 0.059 | 147.3 | 9500 | 57 | amor. |
| 50 | 0.051 | 146.5 | 11300 | 55 | amor. |
| 72 | 0.049 | 145.0 | 9000 | 59 | amor. |
| 90 | 0.053 | 143.3 | 7500 | 57 | amor. |
| 105 | 0.054 | 142.5 | 7000 | 58 | amor. |
| 130 | 0.063 | 141.7 | 6000 | 56 | amor. |
| 160 | 0.063 | 142.5 | 5500 | 57 | amor. |
| 173 | 0.071 | 142.5 | 5200 | 54 | amor. + crys. |
| 220 | 0.11 | 137.7 | 4500 | 52 | amor. + crys. |
| 250 | 0.15 | 135.4 | 4000 | 50 | amor. + crys. |

amor.: amorphous, crys.: crystal

Figure 23:
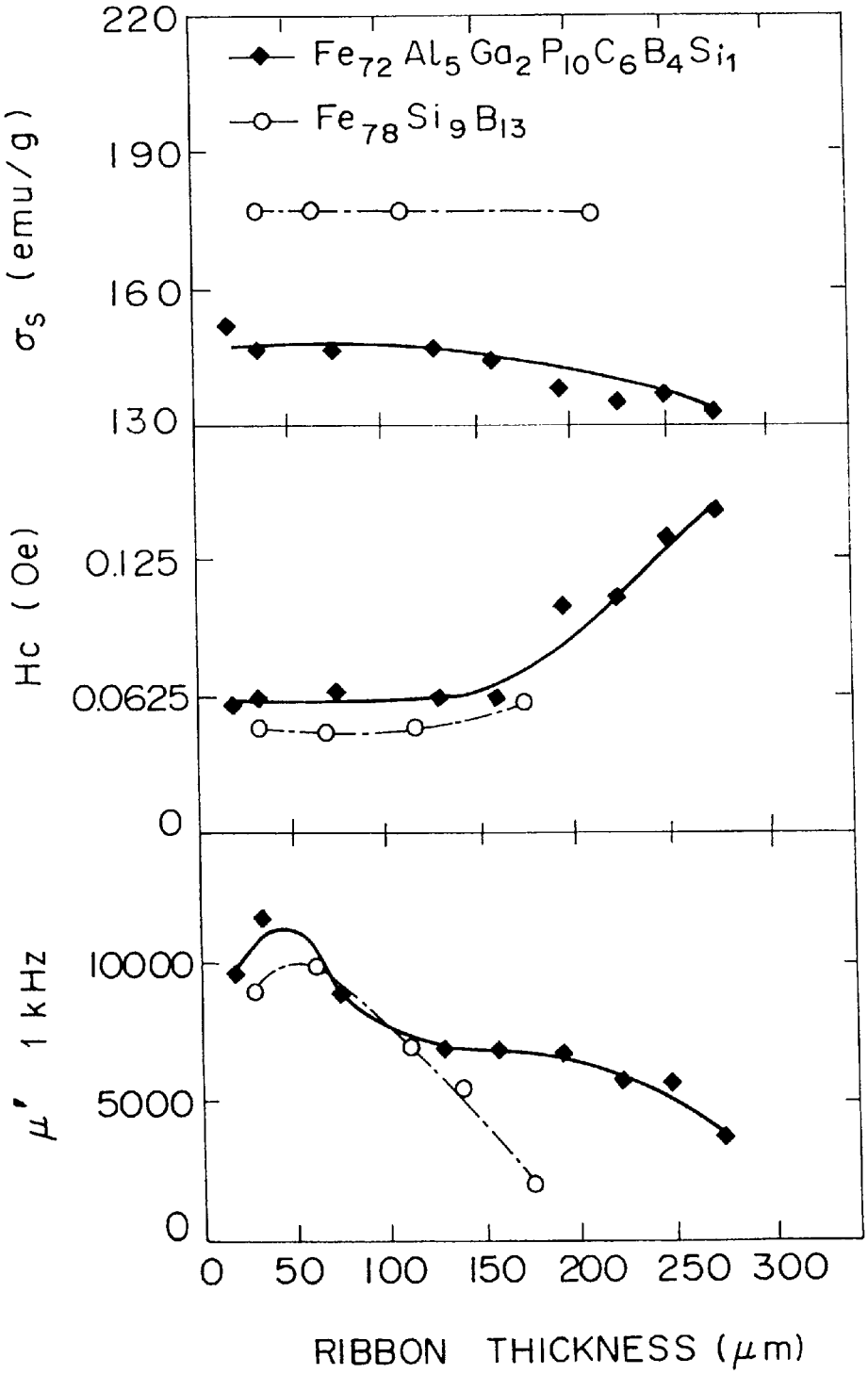
FIG. 23 is a graph comparing the dependence of saturation magnetization, coercive force and permeability on thickness for a comparative sample and a sample formed in accordance with the present invention.

FIG. 23 is a graph illustrating the dependence of saturation magnetization ($\sigma_s$) , coercive force (Hc) and permeability ($\mu'$) on thickness of a sample for comparison having a composition of $Fe_{78}Si_9B_{13}$ and a sample in accordance with the present invention having a composition of $Fe_{72}Al_5Ga_2P_{10}C_6B_4Si_1$, which are annealed at 350° C. for 30 minutes. FIG. 23 illustrates that the Fe based glassy alloy sample of the present invention exhibits less characteristic magnetic deterioration over a thickness range between 20 and 250 $\mu$m as compared to the conventional amorphous alloy sample for comparison. In particular, the sample of the present invention exhibits superior permeability, i.e., not less than 5,000 over a thickness range between 20 and 250 $\mu$m and thus superior soft magnetic characteristics than the conventional sample.

Example 4

Changes in thermal and magnetic characteristics, when the Si content is varied in the sample used in Example 3, were studied in this example.

Figure 24:
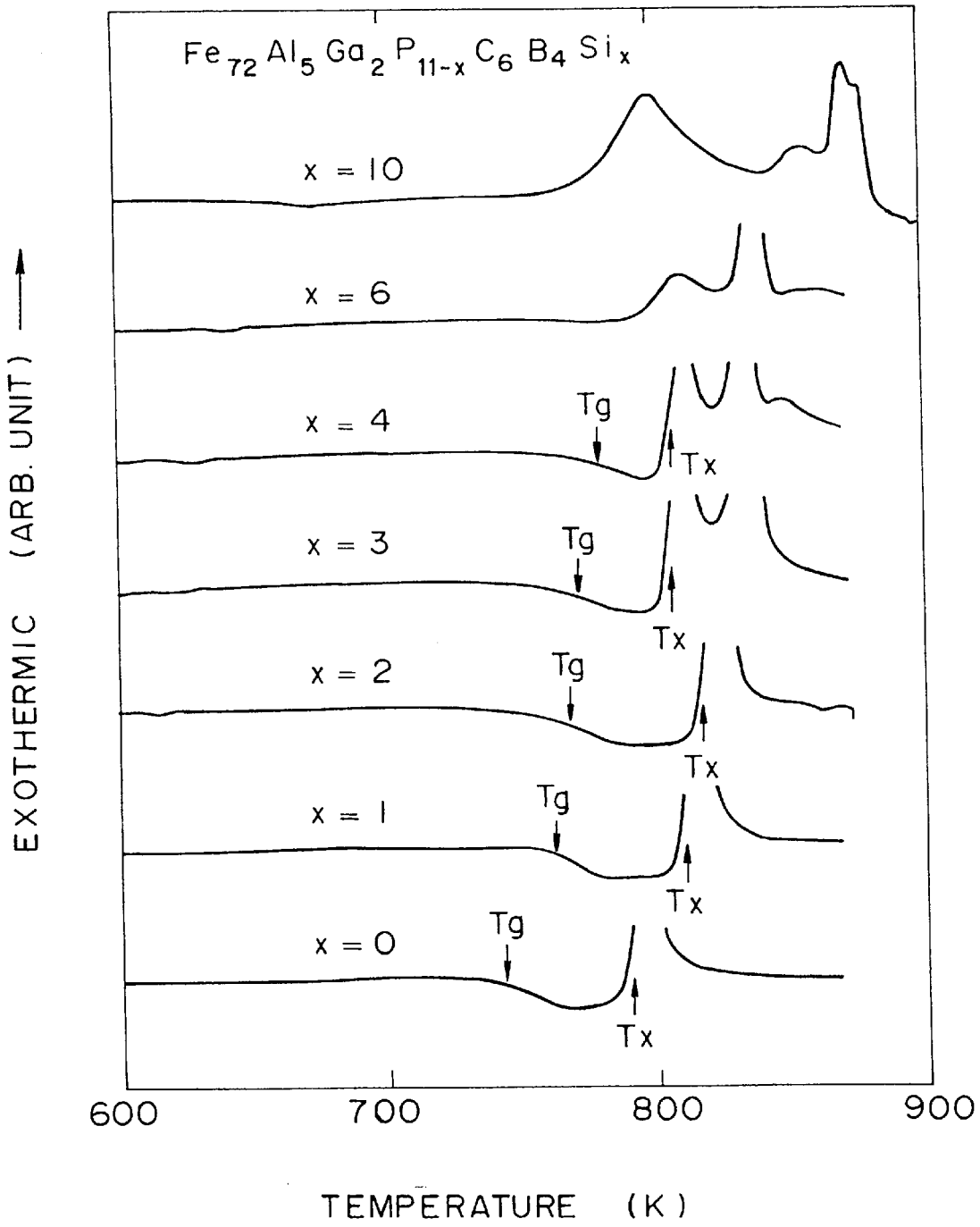
FIG. 24 includes DSC thermograms of samples having compositions of $Fe_{72}Al_5Ga_2P_{11-x}C_6B_4Si_x$.

FIG. 24 shows DSC thermograms of samples having compositions expressed by $Fe_{72}Al_5Ga_2P_{11-x}C_6B_4Si_x$, wherein x=0, 1, 2, 3, 4, 6 and 10. In FIG. 24, glass transition (Tg) is observed in each sample having a Si content between 0 and 4 atomic percent, suggesting the existence of a supercooled region. Thus, it is preferred that the Si content be not more than 4 atomic percent in order to achieve high amorphous phase formability.

Figure 25:
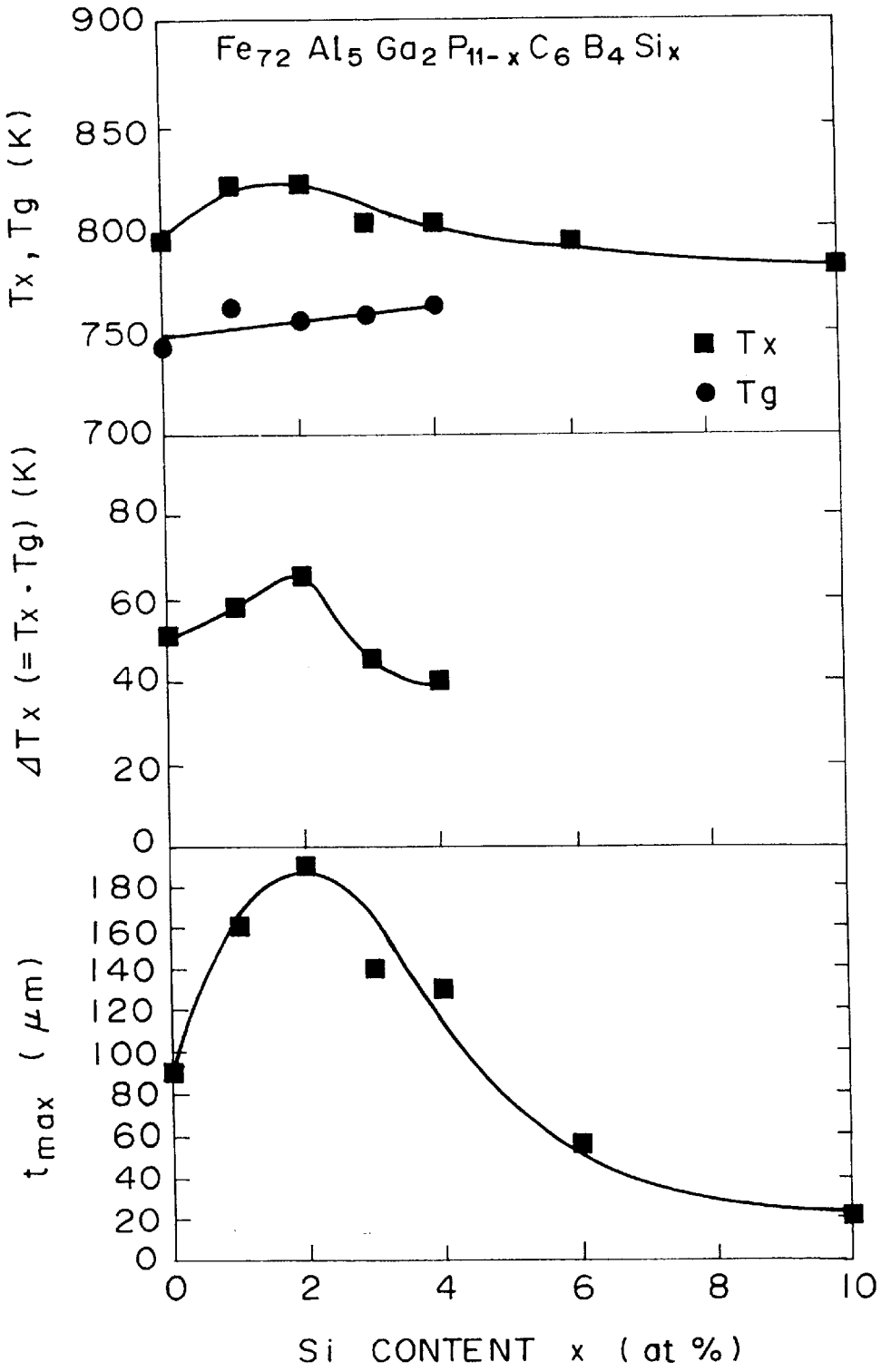
FIG. 25 includes graphs illustrating $T_x$, $\Delta T_x$ and $t_{max}$ of samples expressed by $Fe_{72}Al_5Ga_2P_{11-x}C_6B_4Si_x$and having different Si contents.

FIG. 25 shows the dependence of $T_x$, $\Delta T_x$ and $t_{max}$ on Si content. FIG. 25 demonstrates that $\Delta T_x$ and $t_{max}$ have maximum values at a Si content of 2 atomic percent and the preferable Si content to achieve a $t_{max}$ value of not less than 100 $\mu$m ranges from 1 to 4 atomic percent.

Figure 26:
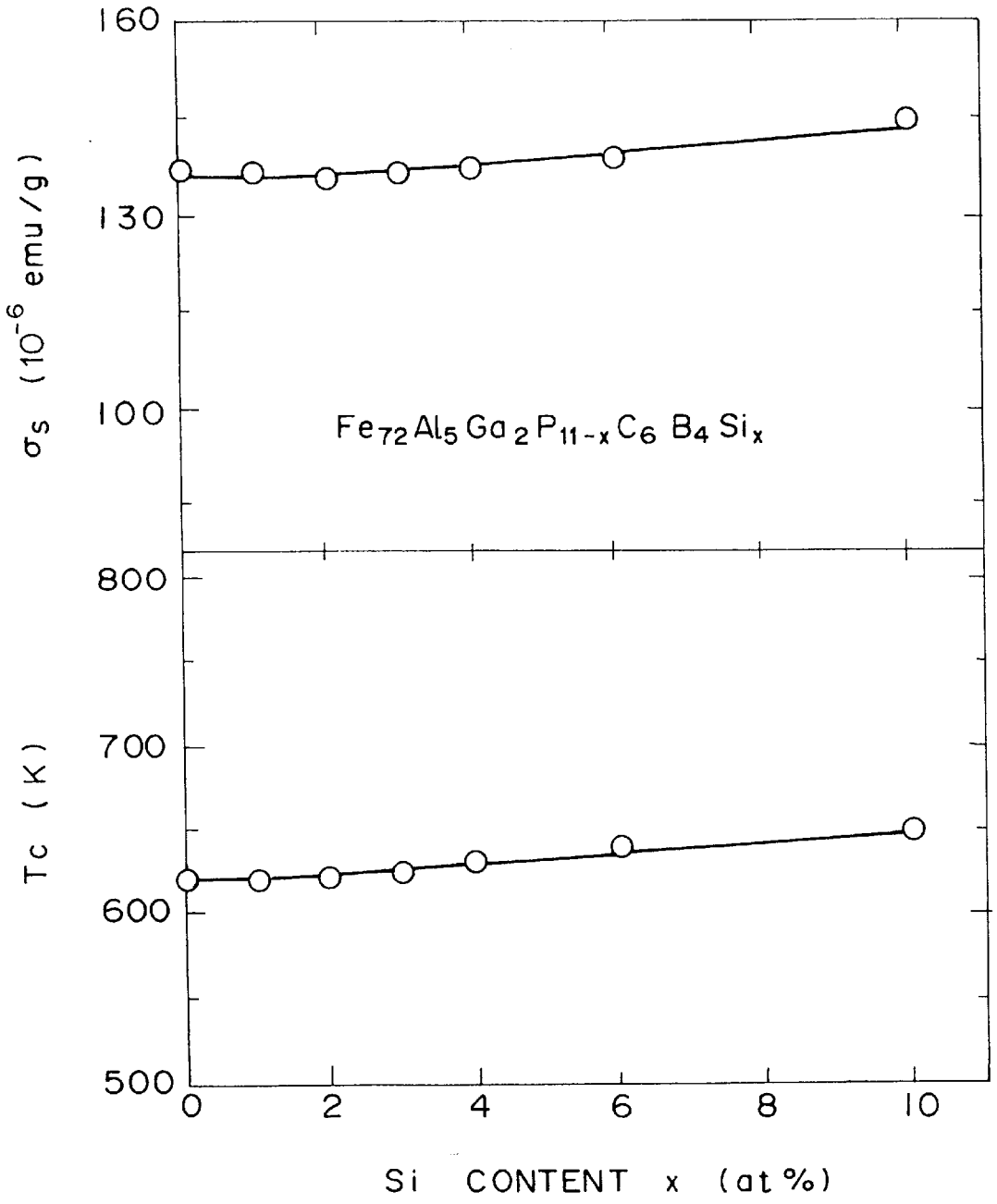
FIG. 26 includes graphs illustrating saturation magnetization and Curie points of samples expressed by $Fe_{72}Al_5Ga_2P_{11-x}C_6B_4Si_x$ and having different Si contents.

FIG. 26 shows the dependence of saturation magnetization ($\sigma_s$) and Curie point ($T_c$) on Si content. As shown in FIG. 25, both the saturation magnetization ($\sigma_s$) and Curie point ($T_c$) are satisfactory levels for a Si content range of 10 atomic percent or less and slightly increase with Si content. Even for a Si content range of over 4 atomic percent without a $\Delta T_x$ value, they are at practical levels for some application fields.

Figure 27:
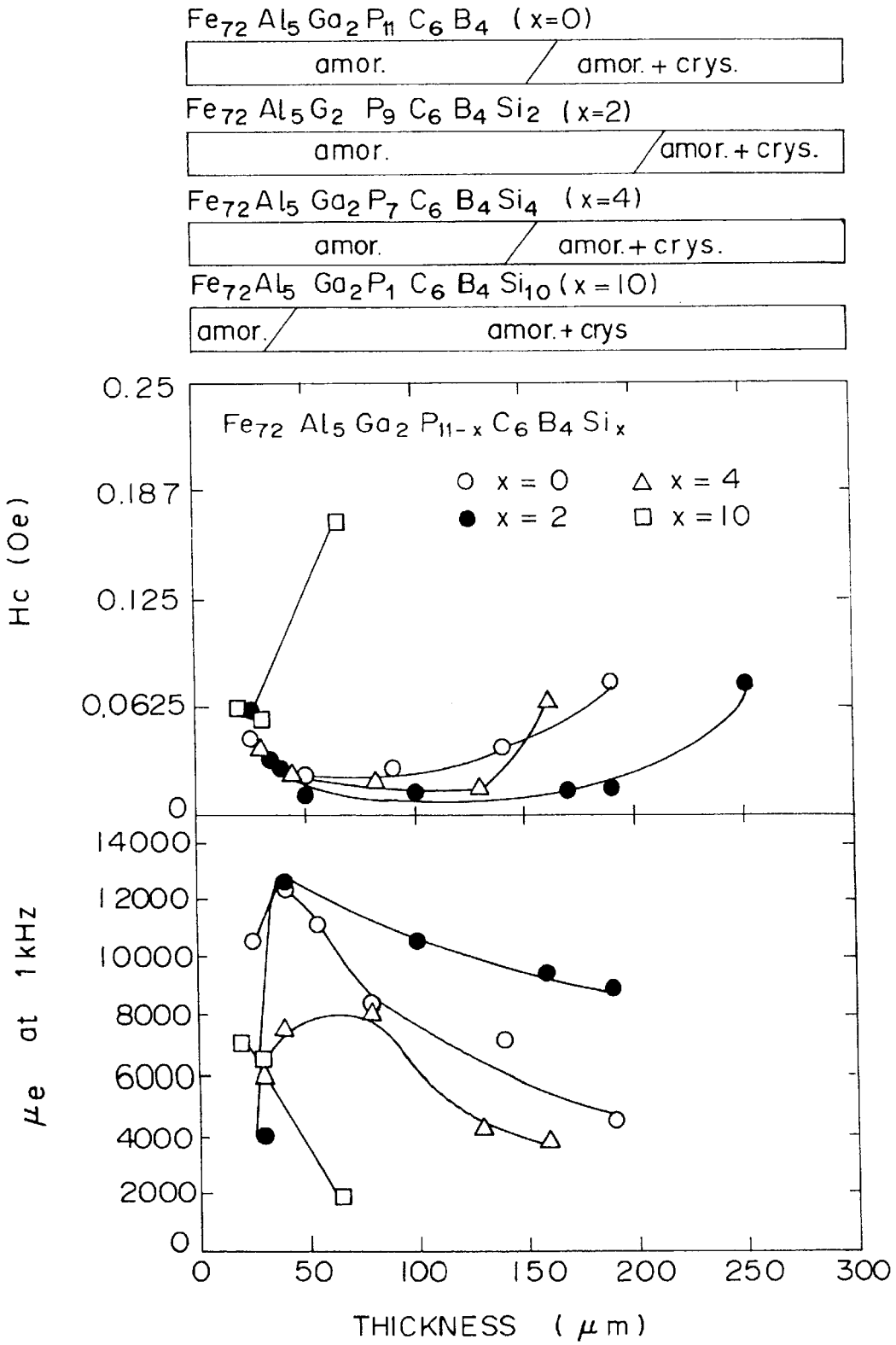
FIG. 27 includes graphs illustrating the dependence of microstructure, coercive force and permeability on thickness of samples expressed by $Fe_{72}Al_5Ga_2P_{11-x}C_6B_4Si_x$ and having different Si contents.

FIG. 27 shows the dependence of coercive force (Hc) and permeability ($\mu_e$) at 1 kHz on thickness of ribbon samples having compositions expressed by $Fe_{72}Al_5Ga_2P_{11-x}C_6B_4Si_x$, wherein x=0, 2, 4 and 10, as well as microstructures. As shown in FIG. 27, the Si-free sample has a minimum Hc value at a thickness of 70 $\mu$m and a maximum $\mu_e$ value at a thickness of 50 $\mu$m and is composed of a single amorphous phase microstructure with a thickness of not more than 150 $\mu$m. In the sample containing 2 atomic percent of Si, a low Hc value of not more than 0.05 Oe and a high $\mu$e value of not less than 9,000 are maintained over a thickness range of not more than 200 $\mu$m. A single amorphous phase microstructure is also maintained over a thickness range of not more than 200 $\mu$m. On the other hand, for a thickness range of less than 50 $\mu$m, the $\mu_e$ value steeply decreases. Thus, the sample in accordance with the present invention exhibits excellent soft magnetic characteristics in a larger thickness region. Such excellent soft magnetic characteristics deteriorate by further increasing the Si content to 4–10 atomic percent, thereby narrowing the single amorphous phase region. However, the $\sigma_s$ value is maintained at a practically high level in samples containing large amounts of Si, as illustrated in FIG. 25, and thus these samples are useful in some application fields.

As set forth above, a Fe based soft magnetic glassy alloy in accordance with the present invention exhibits a temperature distance $\Delta T_x$ of a supercooled liquid of not less than 35° C. and a resistivity of not less than 1.5 $\mu\Omega$m. Thus, the bulk glassy alloy can be prepared without restriction of the thickness. Further, the glassy alloy exhibits excellent soft magnetic characteristics at room temperature.

It is preferable that the glassy alloy contains a metallic element other than Fe and a metalloid element, that the metalloid element is at least one element selected from the group consisting of P, C, B and Ge, and that the metallic element other than Fe is at least one element selected from Groups IIIB and IVB of the Periodic Table, i.e., Al, Ga, In and Sn.

A bulk Fe soft magnetic glassy alloy ribbon exhibiting a high resistivity of not less than 1.5 $\mu\Omega$m and excellent soft magnetic characteristics at room temperature is obtainable in a thickness range of not less than 20 $\mu$m, preferably from 20 to 200 $\mu$m, and, in particular, 20 to 250 $\mu$m when the alloy contains Si. The excellent soft magnetic characteristics represent high saturation magnetization, low coercive force and high permeability.

The present invention is not limited to the examples set forth above, and various changes in composition, production method, annealing condition, and shape can be made by one skilled in the art without departing from the spirit and scope of the invention.

What is claimed is:

1. An Fe based soft magnetic glassy alloy ribbon characterized in that:

a temperature difference, $\Delta T_x = T_x - T_g$, is 35° C. or more, wherein $T_x$ represents the crystallization temperature of the glassy alloy; $T_g$ represents the glass transition temperature of the glassy alloy; resistivity of 1.5 $\mu\Omega$m or more; a ribbon thickness in the range of 25 to 250 $\mu$m; comprising:

0 to 10 atomic percent of Al, 0.5 to 4 atomic percent of Ga, 9 to 15 atomic percent of P, 5 to 7 atomic percent of C, 2 to 10 atomic percent of B, 4 to 10 atomic percent of Si, and Fe.

* * * * *

UNITED STATES PATENT AND TRADEMARK OFFICE

CERTIFICATE OF CORRECTION

PATENT NO. : 5,961,745

DATED : October 5, 1999

INVENTOR(S) : Akihisa Inoue et al.

It is certified that error appears in the above-identified patent and that said Letters Patent is hereby corrected as shown below:

On the Title Page

In column 1, item [22], please change "Mar. 26, 1997" to --Mar. 25, 1997--.

In column 2, line 9, under "ABSTRACT", please change "Tx" to --$T_x$--, and "Tg" to --$T_g$--.

Signed and Sealed this

Twenty-first Day of November, 2000

*Attest:*

Q. TODD DICKINSON

*Attesting Officer*

*Director of Patents and Trademarks*